US007967018B2

(12) United States Patent
Nelson et al.

(10) Patent No.: US 7,967,018 B2
(45) Date of Patent: Jun. 28, 2011

(54) METHODS FOR SCULPTING CIGARETTES, AND ASSOCIATED APPARATUSES

(75) Inventors: John Larkin Nelson, Lewisville, NC (US); Gary Lee Wood, Rural Hall, NC (US); Vernon Brent Barnes, Advance, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 758 days.

(21) Appl. No.: 11/933,680

(22) Filed: Nov. 1, 2007

(65) Prior Publication Data

US 2009/0114234 A1 May 7, 2009

(51) Int. Cl.
*A24C 1/18* (2006.01)

(52) U.S. Cl. ..... 131/85; 131/77; 131/86

(58) Field of Classification Search ..... 131/77, 131/85, 86

See application file for complete search history.

(56) References Cited

U.S. PATENT DOCUMENTS

| | | | | |
|---|---|---|---|---|
| 579,421 | A | 3/1897 | Campbell | |
| 753,963 | A | 3/1904 | Doscher | |
| 1,865,943 | A | 7/1932 | Miller | |
| 1,971,869 | A * | 8/1934 | Molins | 131/60 |
| 2,308,323 | A | 1/1943 | Williams | |
| 3,214,009 | A | 10/1965 | Tamarin | |
| 3,288,147 | A | 11/1966 | Molins et al. | |
| 3,308,600 | A | 3/1967 | Erdmann et al. | |
| 3,915,176 | A | 10/1975 | Heitmann et al. | |
| 4,280,187 | A | 7/1981 | Reuland et al. | |
| 4,281,670 | A | 8/1981 | Heitmann et al. | |
| 4,281,671 | A | 8/1981 | Bynre et al. | |
| 4,291,713 | A | 9/1981 | Frank | |
| 4,474,190 | A | 10/1984 | Brand | |
| 4,534,367 | A | 8/1985 | Newsome | |
| 4,535,790 | A | 8/1985 | Wheless | |
| 4,543,967 | A | 10/1985 | Labbe | |
| 4,571,917 | A | 2/1986 | Wheless et al. | |
| 4,574,816 | A | 3/1986 | Rudszinat | |
| 4,596,257 | A | 6/1986 | Garthaffner et al. | |
| 4,637,410 | A | 1/1987 | Luke | |
| 4,736,754 | A | 4/1988 | Heitmann et al. | |
| 4,781,203 | A | 11/1988 | La Hue | |
| 4,807,809 | A | 2/1989 | Pryor et al. | |
| 4,844,100 | A | 7/1989 | Holznagel | |

(Continued)

FOREIGN PATENT DOCUMENTS

| | | |
|---|---|---|
| CH | 110487 | 6/1925 |

(Continued)

*Primary Examiner* — Richard Crispino
*Assistant Examiner* — Dionne W Mayes
(74) *Attorney, Agent, or Firm* — Womble Carlyle Sandridge & Rice, PLLC

(57) ABSTRACT

A cigarette-making method is provided, comprising forming an elongate tobacco rod having a non-circular cross-sectional shape and opposed ends, by circumscribing a tobacco charge with a wrapping material. A filter element is formed having opposed ends and a non-circular cross-sectional shape corresponding to the cross-sectional shape of the tobacco rod, by circumscribing a filter material with a plug wrap material. One end of the tobacco rod is axially aligned and abutted with one end of the filter element, and a tipping material is applied about the tobacco rod and the filter element, wherein the tipping material extends across the abutting ends thereof, so as to join the tobacco rod with the filter element and form a cigarette having a non-circular cross-sectional shape along a length thereof. Associated apparatuses and methods are also provided.

6 Claims, 15 Drawing Sheets

U.S. PATENT DOCUMENTS

| | | | |
|---|---|---|---|
| 4,850,301 | A | 7/1989 | Greene, Jr. et al. |
| 4,862,905 | A | 9/1989 | Green, Jr. et al. |
| 4,878,506 | A | 11/1989 | Pinck et al. |
| 5,012,823 | A | 5/1991 | Keritsis et al. |
| 5,025,814 | A | 6/1991 | Raker |
| 5,060,664 | A | 10/1991 | Siems et al. |
| 5,060,665 | A | 10/1991 | Heitmann |
| 5,156,169 | A | 10/1992 | Holmes et al. |
| 5,191,906 | A | 3/1993 | Myracle, Jr. |
| 5,220,930 | A | 6/1993 | Gentry |
| H1271 | H | 1/1994 | Shouse |
| 5,387,285 | A | 2/1995 | Rivers |
| 5,632,285 | A | 5/1997 | Dahlgrun |
| 5,632,287 | A | 5/1997 | Hayworth et al. |
| 6,229,115 | B1 | 5/2001 | Voss et al. |
| 6,360,751 | B1 | 3/2002 | Fagg et al. |
| 6,647,870 | B2 | 11/2003 | Kohno |
| 6,779,530 | B2 | 8/2004 | Kraker |
| 6,848,449 | B2 | 2/2005 | Kitao et al. |
| 6,904,917 | B2 | 6/2005 | Kitao et al. |
| 7,074,170 | B2 | 7/2006 | Lanier, Jr. et al. |
| 7,115,085 | B2 | 10/2006 | Deal |
| 7,234,471 | B2 | 6/2007 | Fitzgerald et al. |
| 7,237,559 | B2 | 7/2007 | Ashcraft et al. |
| 7,275,548 | B2 | 10/2007 | Hancock et al. |
| 7,281,540 | B2 | 10/2007 | Barnes et al. |
| 7,296,578 | B2 | 11/2007 | Read, Jr. |
| 2001/0047923 | A1 | 12/2001 | Spatafora |
| 2003/0136419 | A1 | 7/2003 | Muller |
| 2003/0145866 | A1 | 8/2003 | Hartmann |
| 2004/0011367 | A1 * | 1/2004 | Bohdan ..... 131/193 |
| 2005/0066986 | A1 | 3/2005 | Nestor et al. |
| 2005/0103355 | A1 | 5/2005 | Holmes |
| 2006/0108199 | A1 | 5/2006 | Spatafora |
| 2006/0272655 | A1 | 12/2006 | Thomas et al. |
| 2007/0006888 | A1 | 1/2007 | Hicks et al. |
| 2007/0068540 | A1 | 3/2007 | Thomas et al. |
| 2007/0215167 | A1 | 9/2007 | Crooks et al. |
| 2007/0246055 | A1 | 10/2007 | Oglesby |
| 2008/0029111 | A1 | 2/2008 | Dube et al. |
| 2008/0029118 | A1 | 2/2008 | Nelson et al. |

FOREIGN PATENT DOCUMENTS

| | | | |
|---|---|---|---|
| CH | 176915 | A | 5/1935 |
| CH | 586136 | A4 | 3/1977 |
| DE | 333 476 | | 2/1921 |
| DE | 932 895 | | 9/1955 |
| DE | 1 934 930 | | 3/1966 |
| EP | 0 647 411 | A1 * | 4/1995 |
| GB | 421125 | | 12/1934 |
| GB | 2 170 986 | A | 8/1986 |
| WO | WO 97/01291 | A1 | 1/1997 |
| WO | WO 2004/047572 | A1 | 6/2004 |
| WO | WO 2004/057986 | A2 | 7/2004 |

* cited by examiner

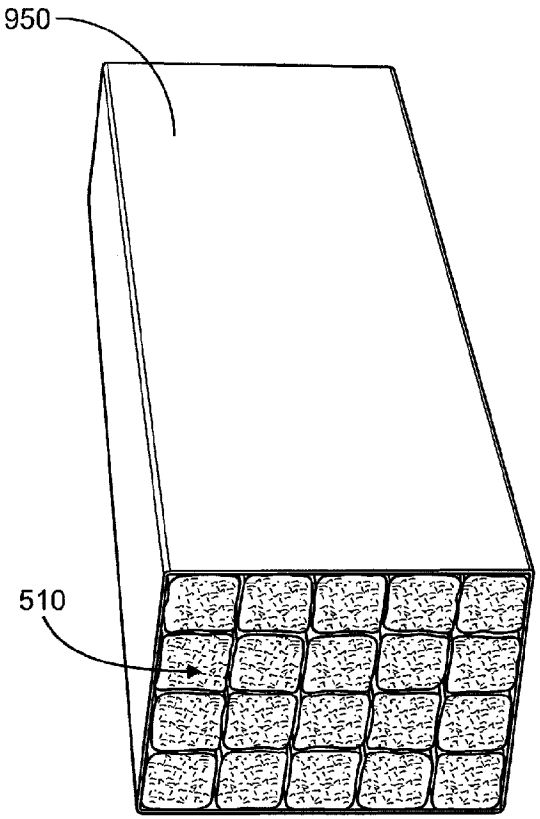
FIG. 13A
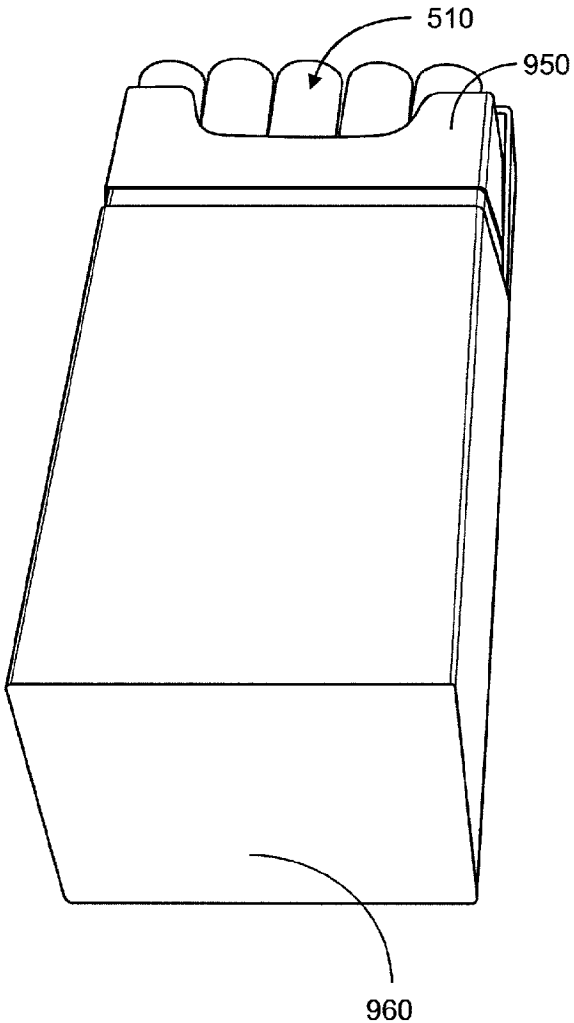

METHODS FOR SCULPTING CIGARETTES, AND ASSOCIATED APPARATUSES

BACKGROUND OF THE INVENTION

1. Field of the Invention

Embodiments of the present invention relate to apparatuses and methods for manufacturing smoking articles components thereof, and, more particularly, to apparatuses and methods for assembling a smoking article, such as a cigarette that has a longitudinally extending cross-sectional shape that can be characterized as generally square or rectangular.

2. Description of Related Art

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). Normally, a generally cylindrical cigarette has a circular longitudinally extending cross-sectional shape, and each of the lighting end and mouth end faces thereof extend virtually perpendicular to the longitudinal axis of that cigarette. A cigarette typically is employed by a smoker by lighting one end thereof and burning the tobacco rod. The smoker then receives mainstream smoke into his/her mouth by drawing on the opposite end (e.g., the filter end) of the cigarette.

Certain attempts have been made to alter the appearance of smoking articles, such as cigarettes. For example, there have been attempts to alter the color of the wrapping material of the tobacco rod (e.g., cigarettes marketed under the trade name "More" by R. J. Reynolds Tobacco Company possess cigarette rod wrapping papers exhibiting a brown color). Additionally, for example, certain attempts have been made to alter the circumference of a cigarette. See, for example, U.S. Pat. No. 4,637,410 to Luke. Furthermore, attempts have been to produce cigarettes having cross-sectional shapes other than circular. See, for example, the types cigarettes set forth in U.S. Pat. Nos. 579,421 to Campbell; 4,535,790 to Wheless; 4,571,917 to Wheless et al.; 4,596,257 to Garthaffner et al.; and 5,632,287 to Hayworth et al.; and U.S. Stat. Inv. Reg. No. H1271 to Shouse.

It would be highly desirable to provide manners and methods, and associated equipment, for producing smoking articles, such as filtered cigarettes, that have a cross-sectional shape that can be characterized as not being generally circular or oval in nature.

BRIEF SUMMARY OF THE INVENTION

The present invention relates to an apparatus and process for providing smoking articles, such as filtered cigarettes, that can be characterized as having cross-sectional shapes that are generally square or rectangular in nature. In some instances, within the scope of the present invention, the smoking articles may be formed with a generally triangular cross-sectional shape. In any instance, the generally square or rectangular cross-sectional shape may be characterized as having two defined pairs of opposing sides, whether those sides be entirely linear or planar; at least partially linear or planar; or at least partially arcuate, between successive creases, wherein such a substantially square or rectangular cross-sectional shape is distinguishable from an oval (e.g., a cross-sectional shape formed by compressing a circle along a bisecting linear segment) cross-sectional shape.

In one regard, a plurality of manufactured smoking articles (e.g., smoking articles such as filtered cigarettes having a generally circular cross-sectional shape) are assembled and formed in a configuration suitable for insertion into a package; and during formation of those smoking articles into the desired noncircular (and non-oval) configuration, external forces applied to those smoking articles result in those smoking articles having a generally square or rectangular cross-sectional shape.

In another regard, smokable rods for smoking articles, such as tobacco rods for cigarettes, are manufactured such that those rods have a cross-sectional shape that is generally square or rectangular in nature (noncircular and non-oval). In one embodiment, tobacco rod wrapping material supplied from a bobbin can possess at least one longitudinally extending seam or crease (e.g., two, three, four, or more longitudinally extending creases); and as such, the production of wrapped tobacco rods having longitudinally extending creased edges (and hence the production of tobacco rods having a type of sculptured cross-sectional shape) can be facilitated. In another embodiment, the garniture region of an automated cigarette making machine can be adapted to provide form formation of a wrapped tobacco rod having a generally square or rectangular cross-sectional shape. In yet another embodiment, a continuous wrapped tobacco rod exiting the garniture region of an automated cigarette making machine is subjected to external forces (e.g., before and/or after that continuous wrapped tobacco rod is subdivided into pre-determined lengths) so as to result in the formation of a plurality of rods having generally square or rectangular cross-sectional shapes.

In another regard, components for smoking articles, such as filter rods useful for production of filter elements for cigarettes, are manufactured such that those rods have a cross-sectional shape that is generally square or rectangular in nature. In one embodiment, plug wrap material supplied from a bobbin can possess at least one longitudinally extending crease (e.g., two, three or four longitudinally extending creases); and as such, the production of filter rods having longitudinally extending creased edges (and hence the production of filter elements having a type of sculptured cross-sectional shape) can be facilitated. In another embodiment, the garniture region of an automated filter making machine can be adapted to provide form formation of a filter rod having a generally square or rectangular cross-sectional shape. In yet another embodiment, a continuous filter rod exiting the garniture region of an automated filter making machine is subjected to external forces (e.g., before and/or after that continuous filter rod is subdivided into pre-determined lengths) so as to result in the formation of a plurality of filter rods having generally square or rectangular cross-sectional shapes.

In another regard, formed hollow tubes of wrapping material can be filled with smokable material (e.g., tobacco cut filler) in a manner such that the resulting smokable rod has a cross-sectional shape that is generally square or rectangular in nature. For example, the hollow tube can be positioned within a cartridge adapted to provide for a smokable rod of the desired shape. Additionally, the smokable material that is inserted into the hollow tube can be configured in a generally square or rectangular cross-sectional shape prior to insertion into the hollow tube.

In yet another regard, multi-segment smoking articles (e.g., filtered cigarettes) having a generally square or rectangular cross-sectional shape can be provided by wrapping at least one patch of tipping material. The tipping material can possess at least one longitudinally extending seam or crease. Such seam or crease most preferably overlies the longitudinally extending squared or sculptured edges of the underlying filter element, as well as a portion of the length of the underlying smokable rod in that region adjacent the filter element with which that smokable rod is aligned. In one embodiment, smoking articles employing two longitudinally extending patches of tipping material possess two longitudinally extending seams.

In yet another regard, multi-segment smoking articles (e.g., filtered cigarettes) having a generally square or rectangular cross-sectional shape can be provided by wrapping aligned segments of filter elements and smokable material, overwrapping those segments with a continuous length of wrapping material to provide a multi-segmented rod, and subdividing that rod at pre-determined locations to provide a plurality of filtered smoking articles.

Still another aspect comprises a cigarette-making apparatus adapted to form a cigarette. Such an apparatus comprises a tobacco rod-forming device configured to form an elongate tobacco rod having a non-circular cross-sectional shape and opposed ends, wherein the tobacco rod includes a wrapping material circumscribing a tobacco charge. A filter rod-forming device is configured to form a filter element having opposed ends and a non-circular cross-sectional shape corresponding to the cross-sectional shape of the tobacco rod. The filter element includes a plug wrap material circumscribing a filter material. An aligning device is configured to axially align and abut one end of the tobacco rod with one end of the filter element. A tipping device is configured to apply a tipping material about the tobacco rod and the filter element, with the tipping material extending across the abutting ends thereof, so as to join the tobacco rod with the filter element and form a cigarette having a non-circular cross-sectional shape along a length thereof.

Another aspect comprises a method of forming a cigarette. In such a method, an elongate tobacco rod having a non-circular cross-sectional shape and opposed ends is formed, wherein the tobacco rod includes a wrapping material circumscribing a tobacco charge. A filter element is formed, having opposed ends and a non-circular cross-sectional shape corresponding to the cross-sectional shape of the tobacco rod, wherein the filter element includes a plug wrap material circumscribing a filter material. One end of the tobacco rod is then axially aligned and abutted with one end of the filter element. A tipping material is applied about the tobacco rod and the filter element, with the tipping material extending across the abutting ends thereof, so as to join the tobacco rod with the filter element and form a cigarette having a non-circular cross-sectional shape along a length thereof.

Yet another aspect comprises a cigarette molding apparatus adapted to mold at least one cigarette, wherein each cigarette has a length and a cigarette cross-sectional shape defining a cigarette cross-sectional area. Such an apparatus comprises a molding element defining an elongate channel having an input end and an opposed output end aligned along an axis. The input end is configured to receive the at least one cigarette having the length thereof coaxially disposed with the axis, and the output end has an output cross-sectional shape defining an output cross-sectional area no less than the cigarette cross-sectional area. An advancement device is operably engaged with the molding element and is configured to advance the at least one cigarette through the elongate channel and along the axis, from the input end and through the output end, such that the at least one cigarette is molded along the length thereof by the output end, at least partially in correspondence with the output cross-sectional shape, upon advancement therethrough.

Another aspect comprises a method of molding at least one cigarette, wherein each cigarette has a length and a cigarette cross-sectional shape defining a cigarette cross-sectional area. Such a method comprises inserting at least one cigarette into an input end of a molding element defining an elongate channel, wherein the input end has an opposed output end aligned along an axis, such that the length of at least one cigarette is coaxially disposed with the axis, and wherein the output end having an output cross-sectional shape defining an output cross-sectional area no less than the cigarette cross-sectional area. The at least one cigarette is advanced through the elongate channel and along the axis, from the input end and through the output end, with an advancement device operably engaged with the molding element, such that the at least one cigarette is molded along the length thereof by the output end, at least partially in correspondence with the output cross-sectional shape, upon advancement therethrough.

Another aspect comprises a cigarette molding apparatus adapted to mold a plurality of cigarettes, wherein each cigarette having a length and a cigarette cross-sectional shape. Such an apparatus comprises a first mold portion configured to receive a length-wise array of cigarettes, wherein the first mold portion longitudinally extends for at least the length of the cigarettes. A second mold portion extends for at least the length of the cigarettes and is configured to complementarily engage the first mold portion so as to define a molded cross-sectional shape and to retain the array of cigarettes therebetween. An actuator is operably engaged with at least one of the first and second mold portions, wherein the actuator is configured to urge one of the first and second mold portions toward the other of the first and second mold portions so as to collectively mold the array of cigarettes according to the molded cross-sectional shape.

Still another aspect comprises a method of molding a plurality of cigarettes, wherein each cigarette has a length and a cigarette cross-sectional shape. Such a method comprises disposing a length-wise array of cigarettes between a first mold portion and a second mold portion, wherein the first and second mold portions each longitudinally extend for at least the length of the cigarettes, and are complementarily configured so as to define a molded cross-sectional shape and to retain the array of cigarettes therebetween. One of the first and second mold portions is urged toward the other of the first and second mold portions with an actuator operably engaged with at least one of the first and second mold portions, such that the first and second mold portions cooperate to collectively mold the array of cigarettes according to the molded cross-sectional shape.

Another aspect comprises a cigarette-making apparatus adapted to form a cigarette. Such an apparatus includes a tobacco rod supplying device configured to supply at least one tobacco rod having a non-circular cross-sectional shape and opposed ends, wherein each tobacco rod includes a wrapping material circumscribing a tobacco charge. A filter rod supplying device is configured to supply at least one filter element having opposed ends and a non-circular cross-sectional shape corresponding to the cross-sectional shape of the at least one tobacco rod, wherein each filter element including a plug wrap material circumscribing a filter material. An aligning device is configured to receive the at least one tobacco rod from the tobacco rod supplying device and the at least one filter element from the filter rod supplying device. The aligning device is further configured to axially align and abut one end of the at least one tobacco rod and one end of the at least one filter element. A wrapping device is configured to apply a garniture material about the at least one tobacco rod and the abutting at least one filter element, and along an entire combined length thereof, so as to join the at least one tobacco rod with the at least one filter element and form a contiguous rod including at least one cigarette, each of the at least one cigarette having a non-circular cross-sectional shape along a length thereof.

Still another aspect comprises a method of forming a cigarette. Such a method includes supplying at least one tobacco rod having a non-circular cross-sectional shape and opposed ends, wherein each tobacco rod including a wrapping material circumscribing a tobacco charge. At least one filter element having opposed ends and a non-circular cross-sectional shape corresponding to the cross-sectional shape of the at least one tobacco rod is then supplied, wherein each filter element including a plug wrap material circumscribing a filter material. The at least one tobacco rod and the at least one filter element are received and axially aligned such that one end of the at least one tobacco rod abuts one end of the at least one filter element. A garniture material is applied about the at least one tobacco rod and the abutting at least one filter element, and along an entire combined length thereof, so as to join the at least one tobacco rod with the at least one filter element and form a contiguous rod including at least one cigarette, wherein each of the at least one cigarette having a non-circular cross-sectional shape along a length thereof.

Aspects of the present invention thus provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 6:
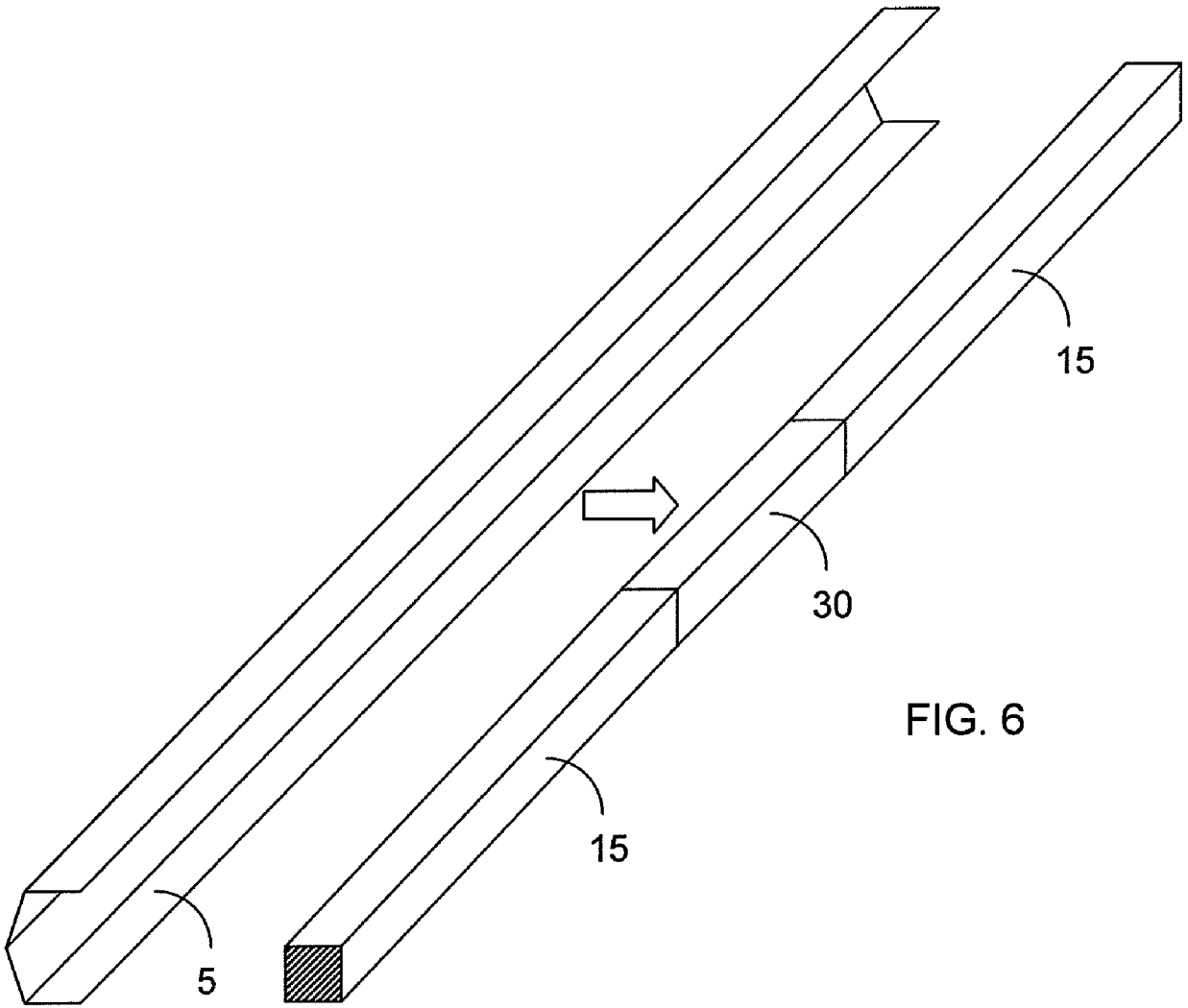
Figure 7:
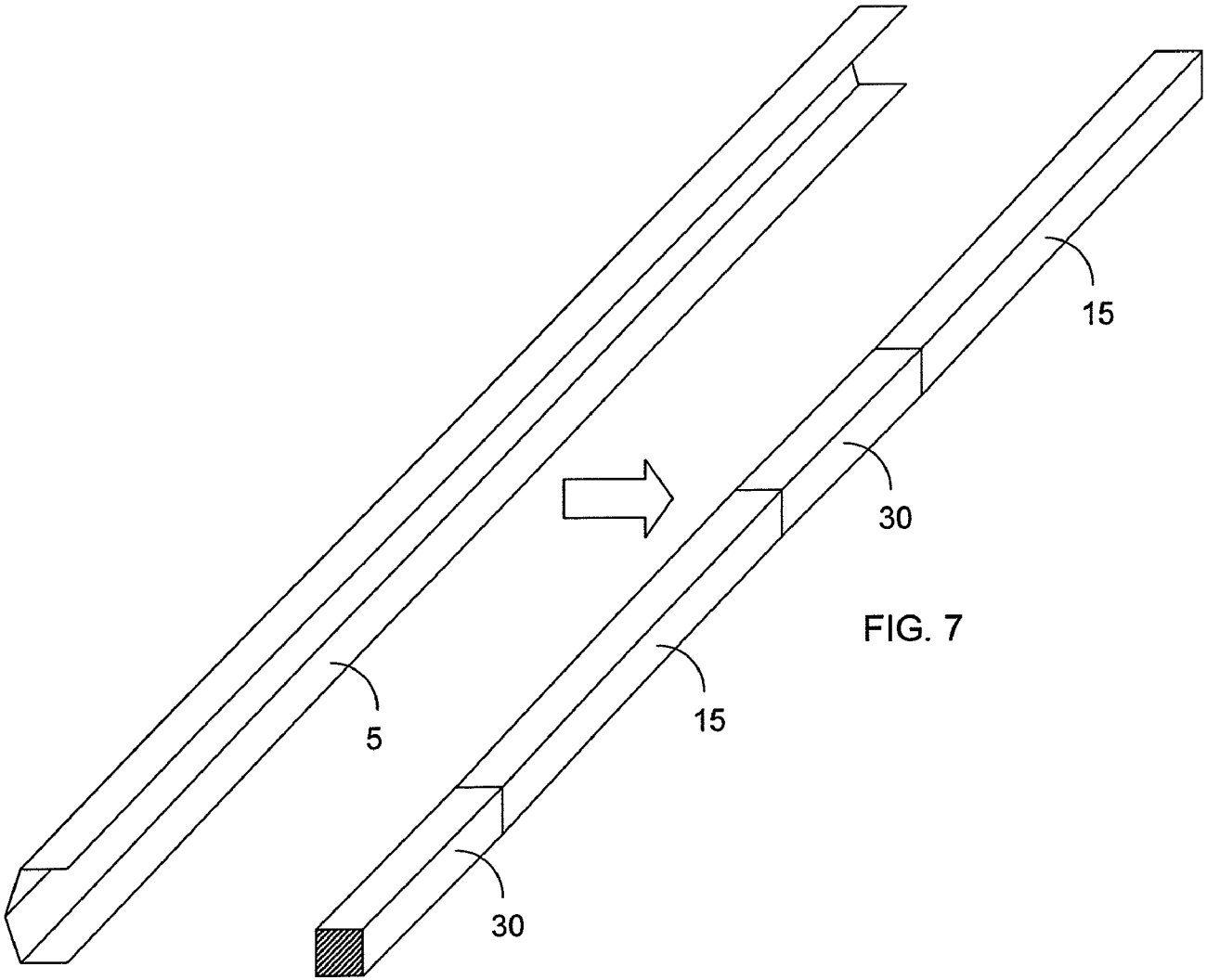
Figure 8:
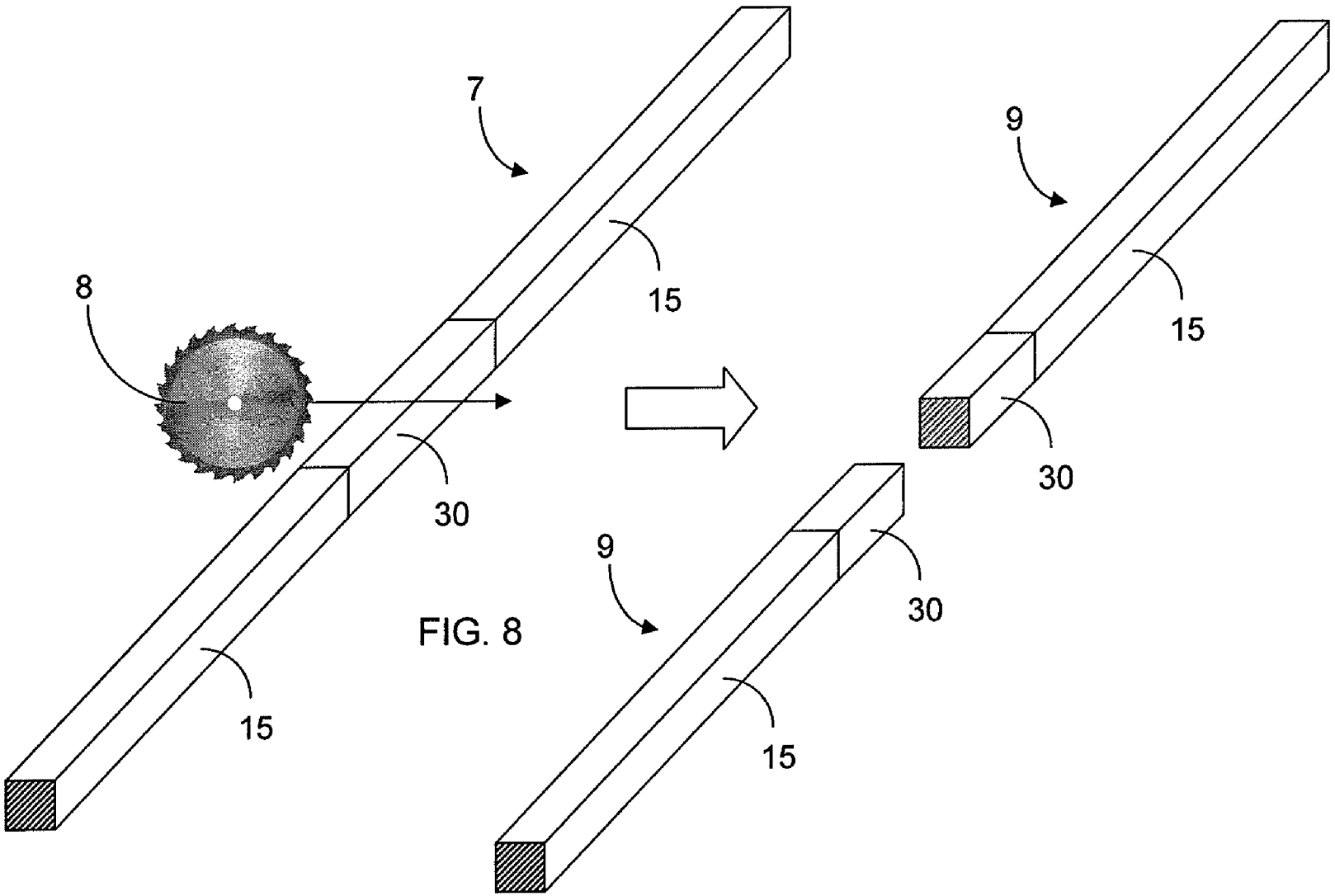
Figure 9:
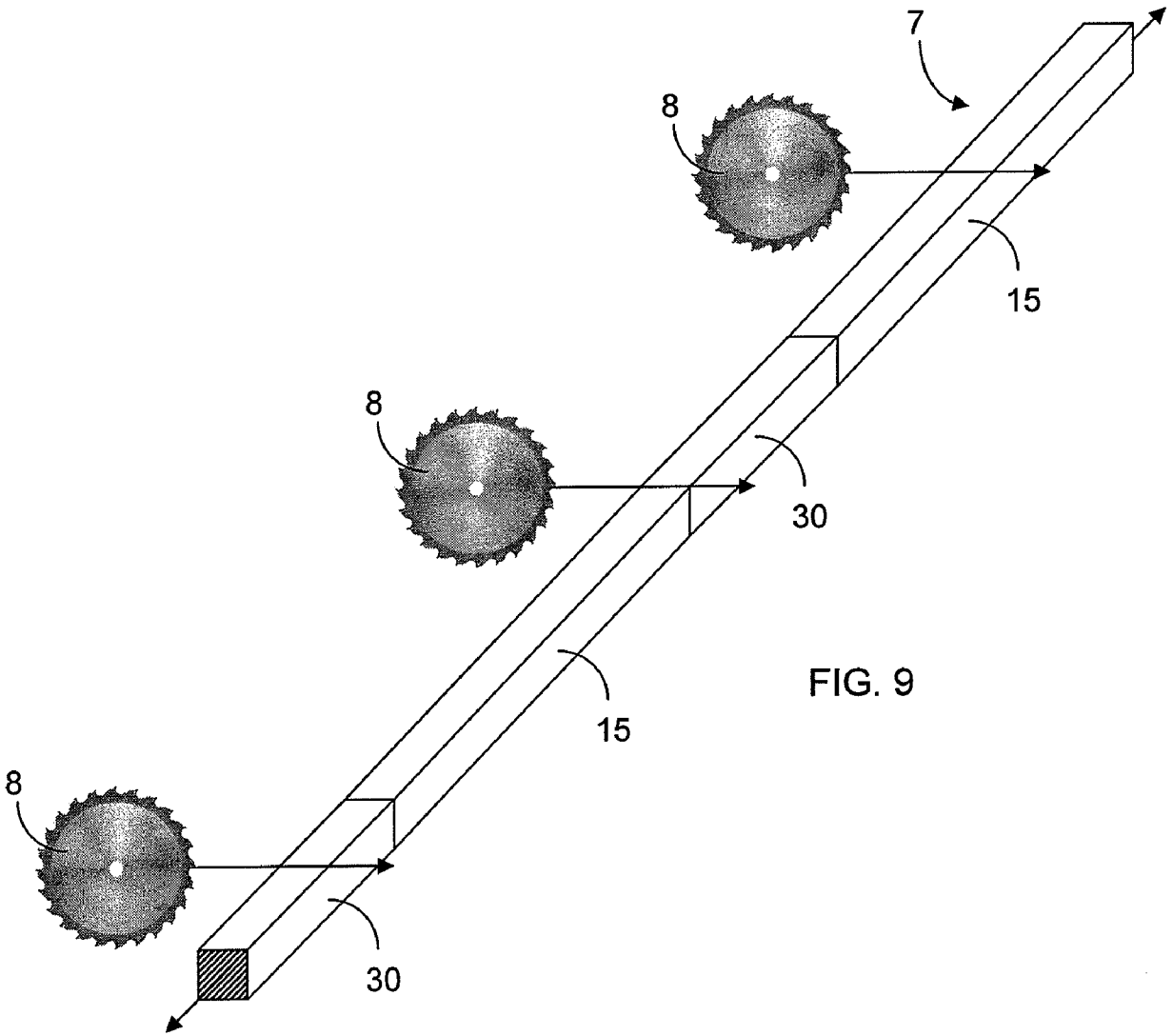
Figure 10A:
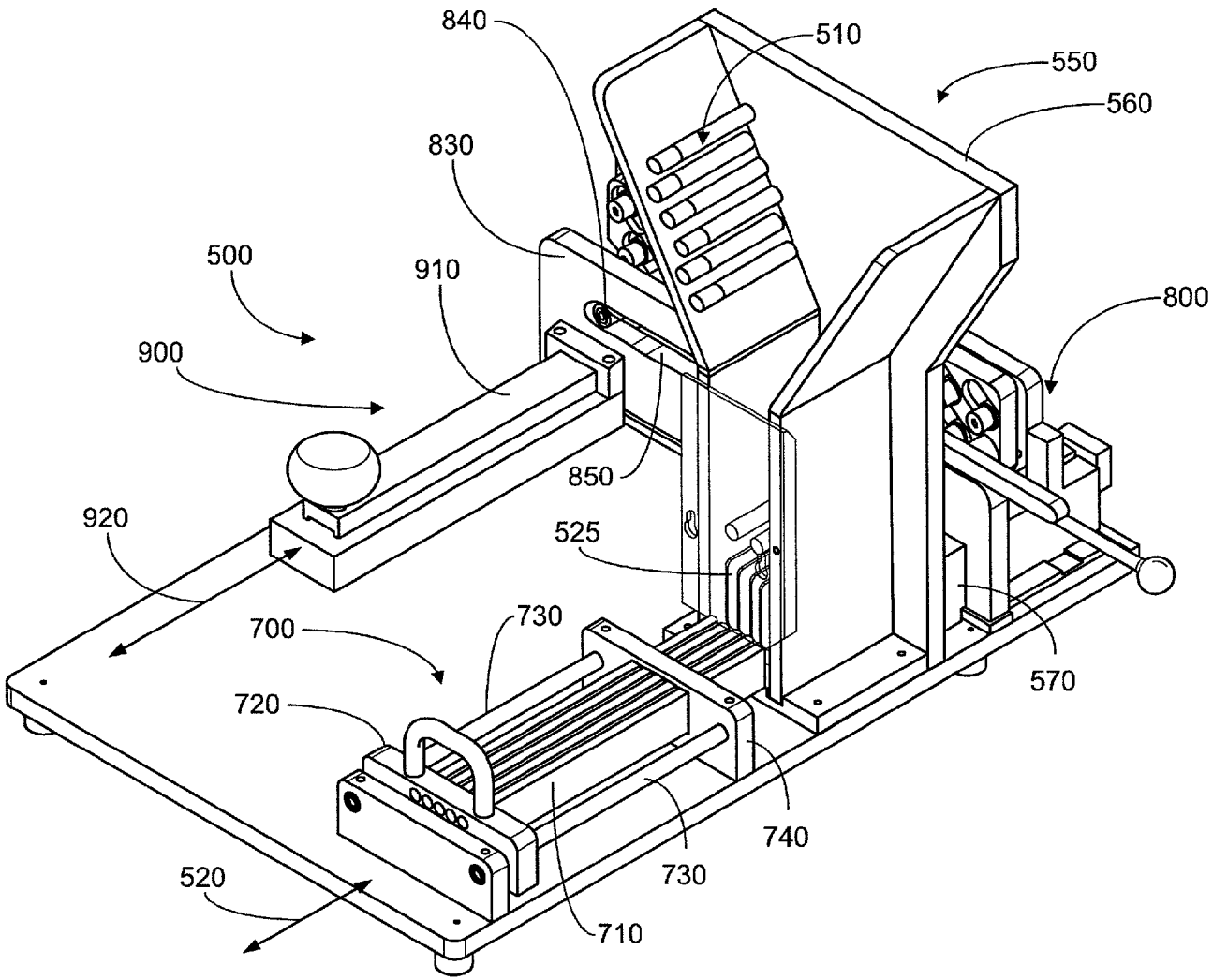
Figure 10B:
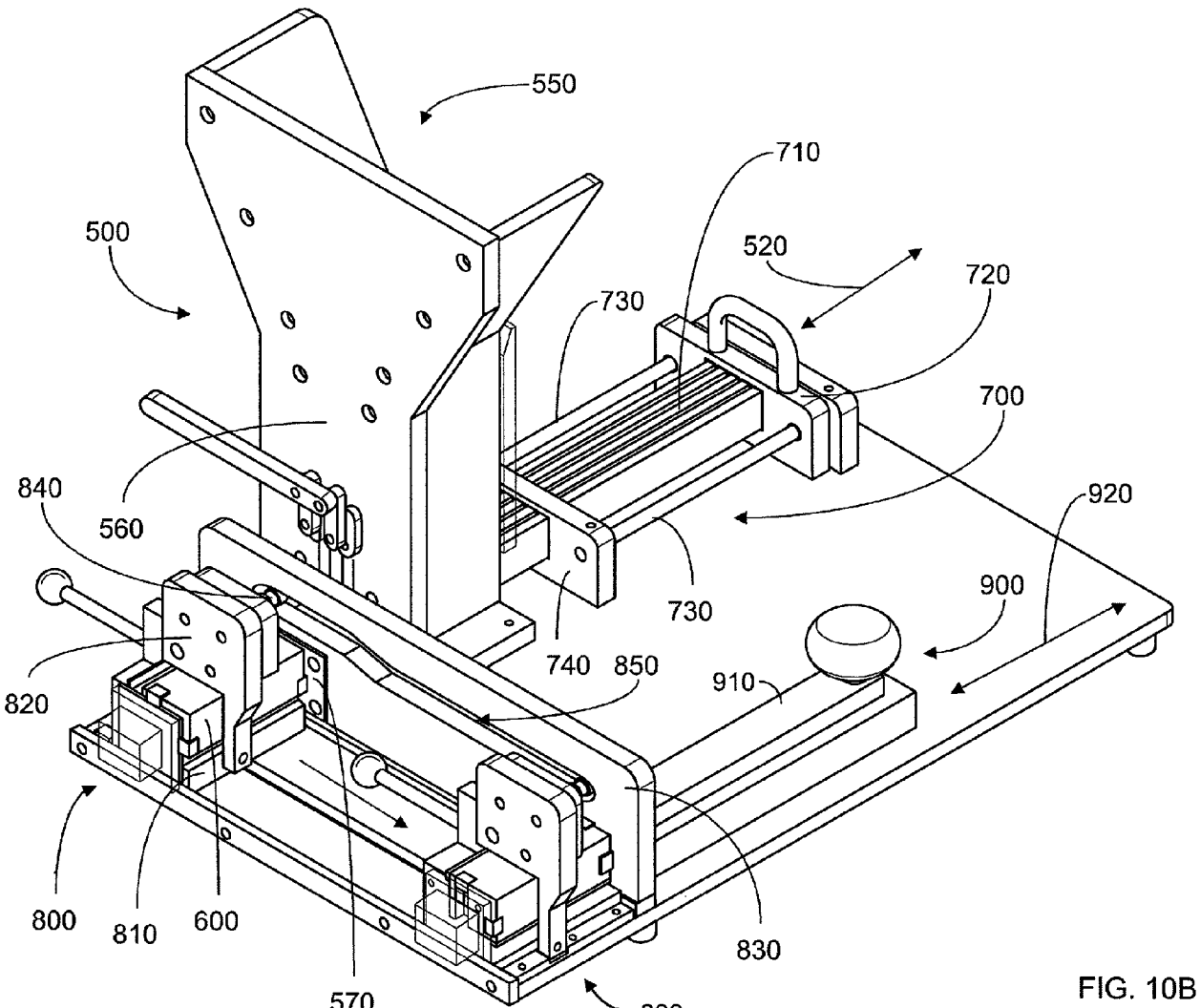
Figure 11:
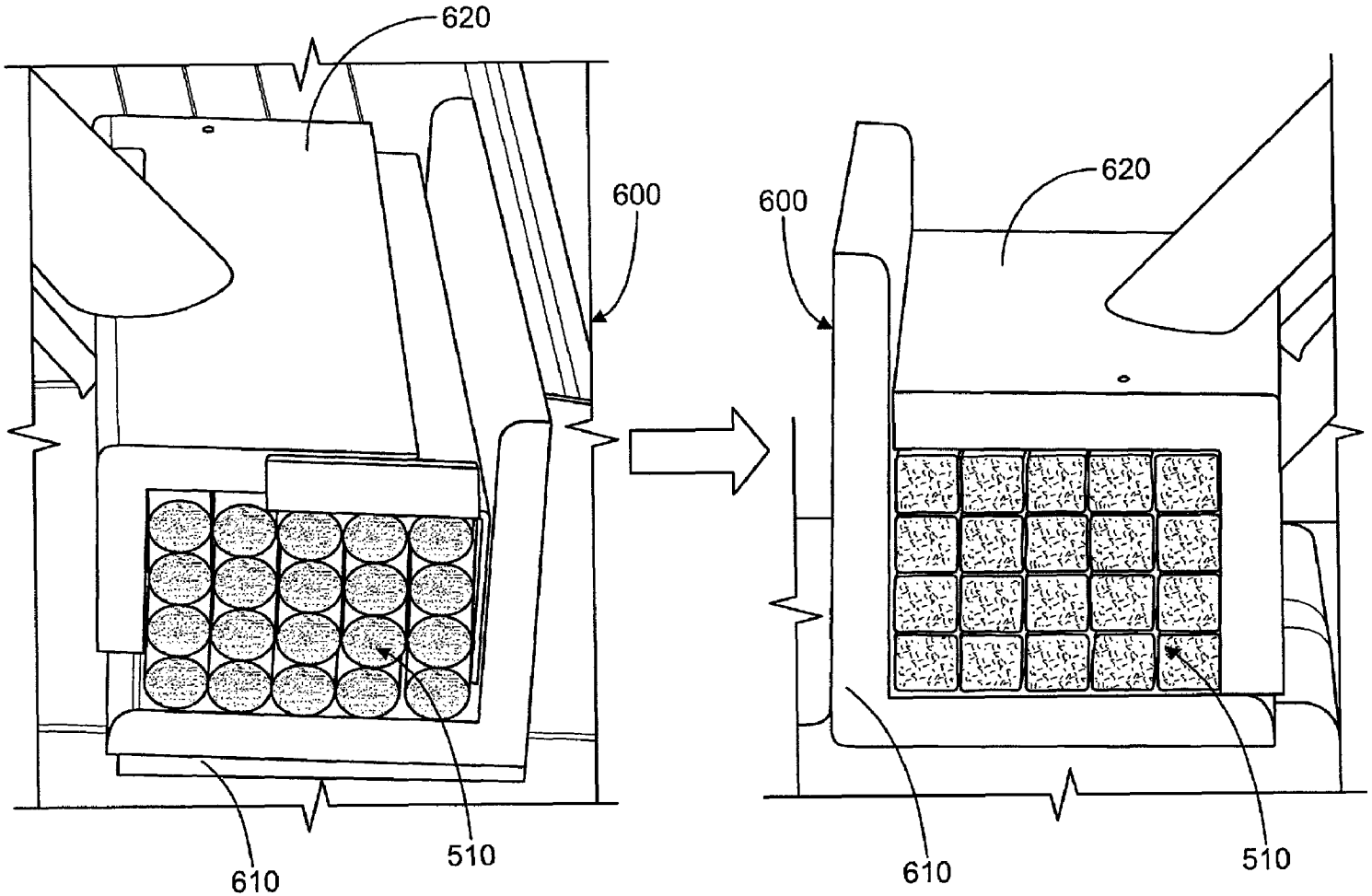
Figure 12:
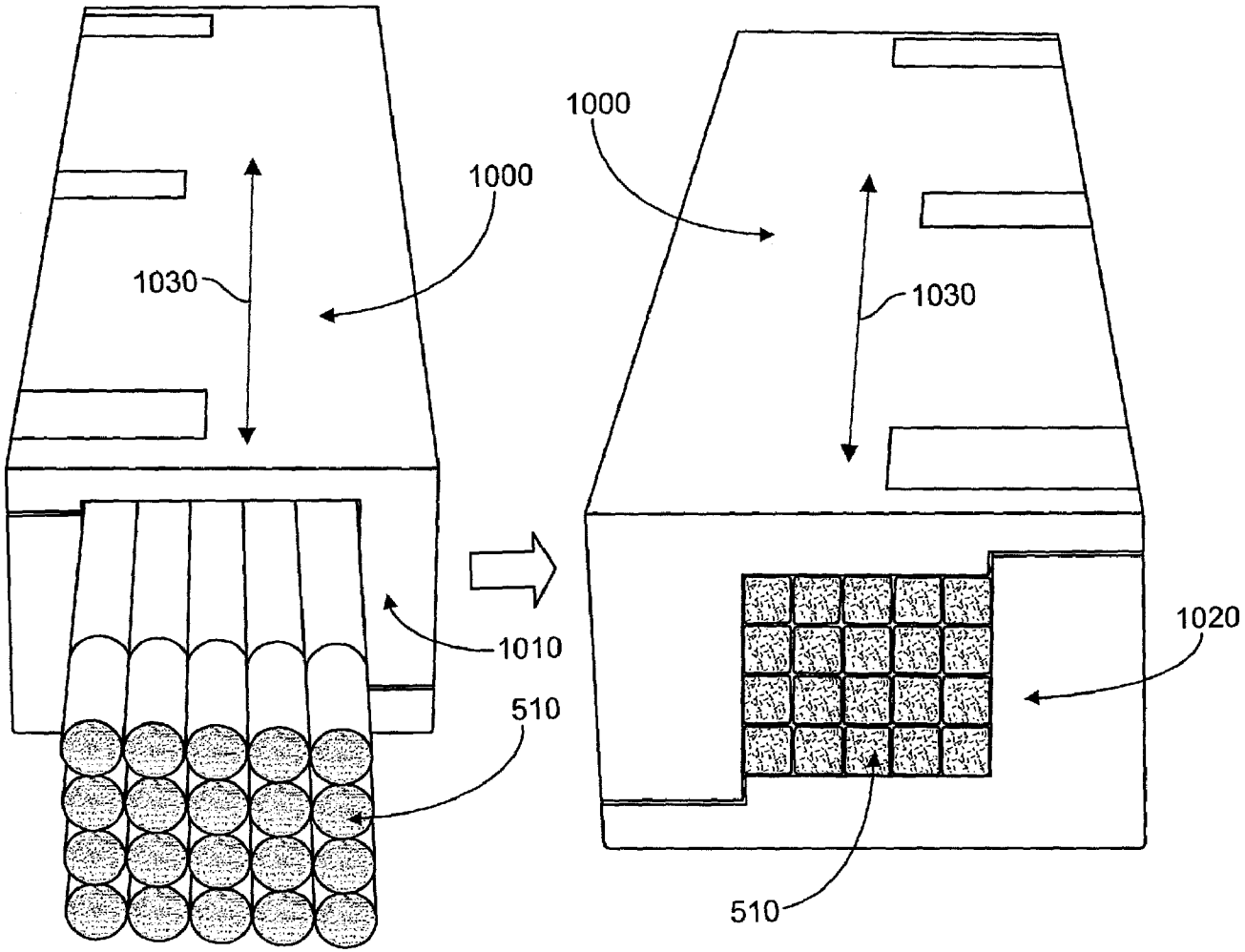
Figure 13B:
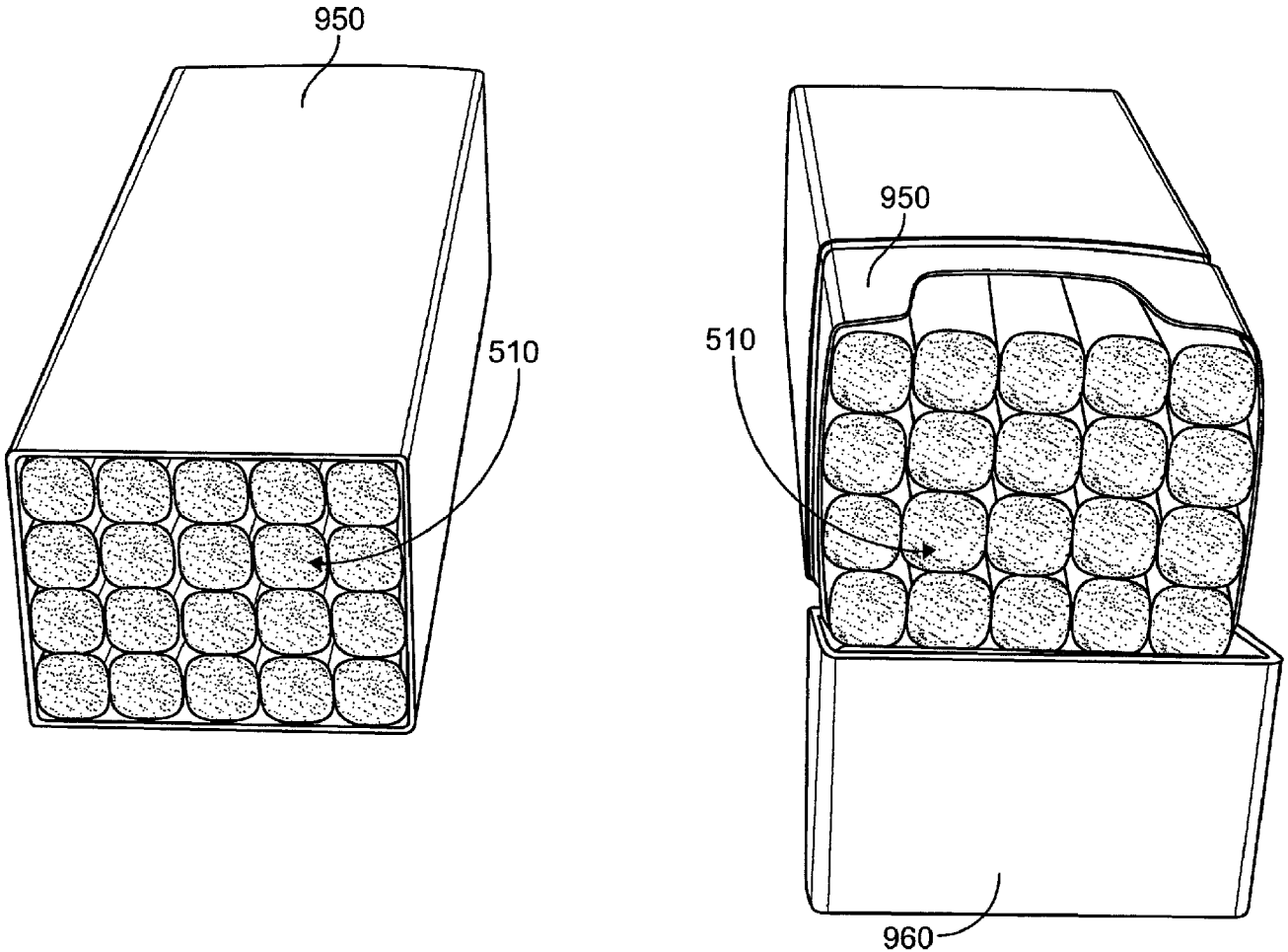

FIGS. 6 and 7 schematically illustrate various combinations of abutting filter elements and tobacco rods, generally in a serially alternating manner, wrapped and secured together by the application of a garniture material along the combined length thereof, so as to form a contiguous rod;

FIGS. 8 and 9 schematically illustrate various manners of subdividing the contiguous rods formed as shown in FIGS. 6 and 7, so as to form individual cigarettes, each having a non-circular cross-sectional shape;

FIGS. 10A and 10B are schematics of a molding apparatus configured to receive and mold an array of as-formed cigarettes, according to one aspect of the present invention;

FIG. 11 is a schematic of a multi-portion mold device configured to receive and mold an array of as-formed cigarettes, according to one aspect of the present invention;

FIG. 12 is a schematic of a single-portion molding element configured to receive and mold an array of as-formed cigarettes, according to one aspect of the present invention; and FIGS. 13A and 13B are schematics of molded arrays of cigarettes packaged into a cigarette jacket and, in turn, a cigarette package, according to one aspect of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Smokeable rods, such as cigarette rods, can be manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. Nos. 4,781,203 to La Hue; 4,844,100 to Holznagel; 5,156,169 to Holmes et al.; 5,191,906 to Myracle, Jr. et al.; 6,647,870 to Blau et al.; 6,848,449 to Kitao et al.; and 6,904,917 to Kitao et al.; 7,234,471 to Fitzgerald et al.; and U.S. Patent Application Publication Nos. 2003/0145866 to Hartman; 2004/0129281 to Hancock et al.; and 2005/0039764 to Barnes et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. Nos. 3,288,147 to Molins et al.; 3,915,176 to Heitmann et al; 4,291,713 to Frank; 4,574,816 to Rudszinat; 4,736,754 to Heitmann et al. 4,878,506 to Pinck et al.; 5,060,665 to Heitmann; 5,012,823 to Keritsis et al. and 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Filtered cigarettes incorporating filter elements provided from filter rods that are produced in accordance with the present invention can be manufactured using traditional types of cigarette making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. Nos. 3,308,600 to Erdmann et al.; 4,281,670 to Heitmann et al.; 4,280,187 to Reuland et al.; and 6,229,115 to Vos et al.; and U.S. Patent Application Publication Nos. 2005/0103355 to Holmes and 2005/1094014 to Read, Jr.; each of which is incorporated herein by reference. The operation of those types of devices will be readily apparent to those skilled in the art of automated cigarette manufacture. Exemplary types of tipping materials are known and also include, for instance, tipping materials used in tipped cigarette configurations as set forth in U.S. patent application Ser. No. 11/462,505 to Dube et al., filed Aug. 4, 2006, which is incorporated herein by reference.

Cigarette filter rods that are produced in accordance with the present invention can be used to provide multi-segment filter rods. Such multi-segment filter rods can be employed for the production of filtered cigarettes possessing multi-segment filter elements. An example of a two-segment filter element is a filter element possessing a first cylindrical segment incorporating activated charcoal particles (e.g., a "dalmation" type of filter segment) at one end, and a second cylindrical segment that is produced from a filter rod produced in accordance with embodiments of the present invention. The production of multi-segment filter rods can be carried out using the types of rod-forming units that have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany.

Various types of cigarette components, including tobacco types, tobacco blends, top dressing and casing materials, blend packing densities; types of paper wrapping materials for tobacco rods, types of tipping materials, and levels of air dilution, can be employed. See, for example, the various representative types of cigarette components, as well as the various cigarette designs, formats, configurations and characteristics, that are set forth in U.S. Pat. Nos. 5,220,930 to Gentry and 6,779,530 to Kraker; U.S. Patent Application Publication Nos. 2005/0016556 to Ashcraft et al., 2005/0066986 to Nestor et al., 2006/0272655 to Thomas et al.; and 2007/0246055 to Oglesby; each of which is incorporated herein by reference.

Filter rods can be manufactured pursuant to embodiments of the present invention using a rod-making apparatus, and an exemplary rod-making apparatus includes a rod-forming unit. Representative rod-forming units are available as KDF-2 and KDF-3E from Hauni-Werke Korber & Co. KG; and as Polaris-ITM Filter Maker from International Tobacco Machinery. Filter material, such as cellulose acetate filamentary tow, typically is processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed. Other types of filter materials, such as gathered paper, nonwoven polypropylene web or gathered strands of shredded web, can be provided using the types of materials, equipment and techniques set forth in U.S. Pat. Nos. 4,807,809 to Pryor et al. and 5,025,814 to Raker. In addition, representative manners and methods for operating a filter material supply units and filter-making units are set forth in U.S. Pat. Nos. 4,281,671 to Bynre; 4,850,301 to Green, Jr. et al.; 4,862,905 to Green, Jr. et al.; 5,060,664 to Siems et al.; 5,387,285 to Rivers and 7,074,170 to Lanier, Jr. et al.

Representative types of filter rods incorporating objects, and representative types of cigarettes possessing filter elements incorporating objects, such as flavor-containing capsules or pellets, can possess the types of components, format and configuration, and can be manufactured using the types of techniques and equipment set forth in U.S. Patent Application Publication Nos. 2005/0070409 A1 to Deal; 2007/0068540 A1 to Thomas et al.; U.S. Pat. No. 4,862,905 to Green, Jr. et al.; and U.S. patent application Ser. No. 11/461,941 to Nelson et al.; which are incorporated herein by reference in their entireties.

Representative types of equipment and methodologies for filling hollow tubes of wrapping material with smokable material are set forth in US Patent Application Publication No. 2007/0006888 to Hicks et al.; which is incorporated herein by reference.

In this regard, some aspects of the present invention are directed to an apparatus and associated method for sculpting a cigarette, wherein the sculpting of the cigarette may occur, for example, during manufacture of the cigarette or following production of the cigarette (i.e., post-production shaping or sculpting). Manufacturing processes for cigarettes are well known, as otherwise detailed herein, and detailed reference to such processes are omitted herein for brevity. In any instance, a cigarette typically includes a tobacco rod portion having a filter element portion attached thereto. Both the filter element and the tobacco rod may be formed in separate processes prior to being joined together to form the cigarette. In such instances, one aspect of the present invention comprises sculpting or otherwise forming each of the filter element and the tobacco rod so as to each have a particular cross-sectional shape along the respective lengths thereof, prior to the filter element and the tobacco rod being joined together to form the cigarette.

One form of a sculpted cigarette contemplates that each of the filter element and the tobacco rod include at least one crease extending longitudinally along the respective lengths thereof (generally the entire length of each component). A smoking article, such as a cigarette, typically includes a rod of a charge or roll of smokable filler material contained in a circumscribing wrapping material. The rod is conventionally referred to as a "tobacco rod." The ends of the tobacco rod are open to expose the smokable filler material. The wrapping material of the tobacco rod can have a wide range of compositions and properties. The selection of a particular wrapping material will be readily apparent to those skilled in the art of cigarette design and manufacture. Tobacco rods can have one layer of wrapping material; or tobacco rods can have more than one layer of circumscribing wrapping material, such as is the case for the so-called "double wrap" tobacco rods, which may be accomplished using, for example, equipment of the type available under the brand name Mulfi from Hauni Maschinenbau AG of Hamburg, Germany. Exemplary types of wrapping materials, wrapping material components and treated wrapping materials are described in U.S. Pat. No. 5,220,930 to Gentry; and U.S. Pat. Application Pub. Nos. 2004/0129281 to Hancock et al.; and 2005/0039764 to Barnes et al.; and PCT Application Pub. No. WO 2004/057986 to Hancock et al.; and PCT Application Pub. No. WO 2004/047572 to Ashcraft et al.; which are incorporated herein by reference in their entireties. Similarly, the filter element may have a generally cylindrical shape, and the diameter thereof may be essentially equal to the diameter of the tobacco rod. The ends of the filter element permit the passage of air and smoke therethrough. The filter element includes filter material (e.g., cellulose acetate tow impregnated with triacetin plasticizer) that is over-wrapped along the longitudinally extending surface thereof with a circumscribing plug wrap material. That is, the filter element is circumscribed along its outer circumference or longitudinal periphery by a layer of plug wrap, and each end is open to expose the filter material.

Figure 2:
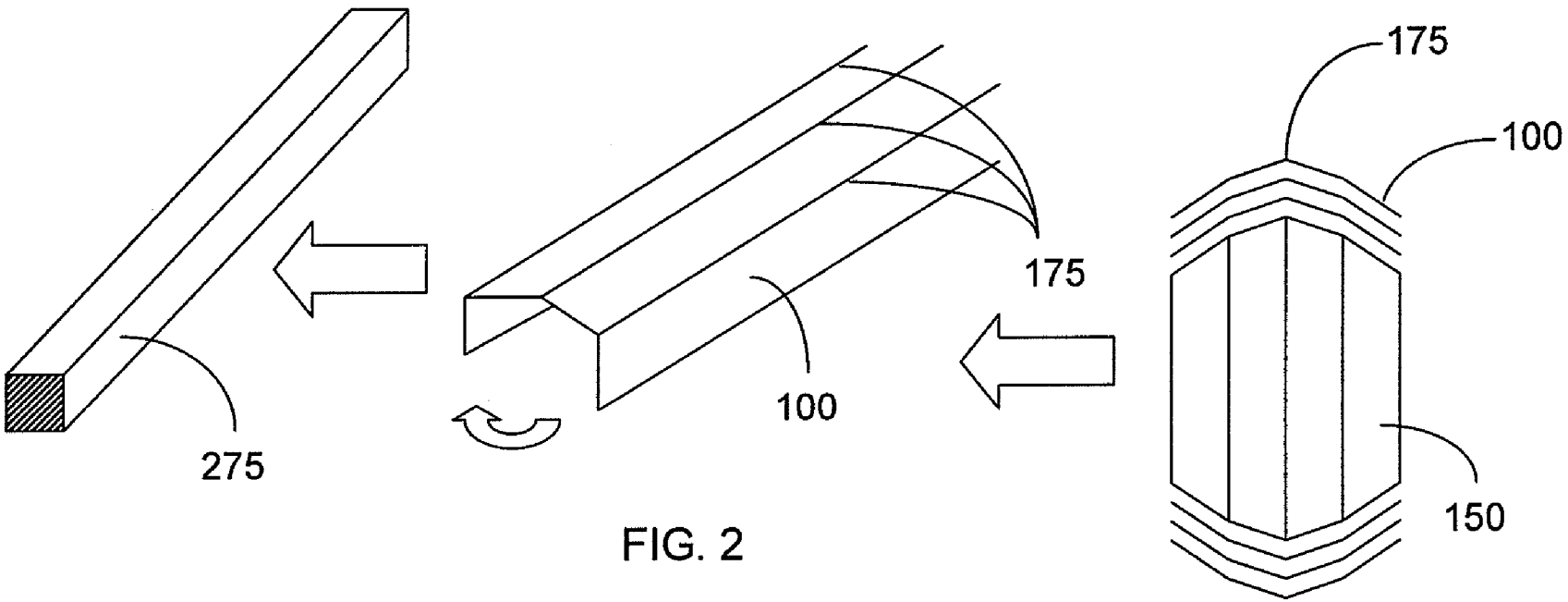
FIG. 2 is a schematic of an elongate material being creased by a creasing device prior to winding onto a spool member, according to one aspect of the present invention.

In each respective process, the wrapping material and the plug wrap material are typically provided in elongate (i.e., strip or sheet) form, and fed from a bulk supply to the forming process for each of the tobacco rod and the filter element (see, e.g., FIG. 2). Accordingly, one aspect contemplates that the at least one longitudinally-extending crease along each component may be achieved by forming that component using an appropriate wrapping material/plug wrap material that already includes the at least one crease. That is, the appropriate wrapping material/plug wrap material, already having the at least one crease formed therein, may be fed from the bulk supply to the respective process such that, when the material is applied, the resulting component is formed to include the at least one longitudinally-extending crease. The wrapping material is thus used by a tobacco rod-forming device to form an elongate tobacco rod, and the plug wrap material issued by a filter rod-forming device to form an elongate filter element, wherein each of the tobacco rod and the filter element may include at least one longitudinally-extending crease. For example, the at least one longitudinally-extending crease may be evident in a cross-sectional shape of the tobacco rod/filter element, where such a cross-sectional shape may be, for instance, a trilateral or a quadrilateral. One skilled in the art will appreciate, however, that many different cross-sectional shapes may include at least one longitudinally-extending crease (see, e.g., U.S. Statutory Invention Registration No. H1271 to Shouse).

Figures 1A, 1B:
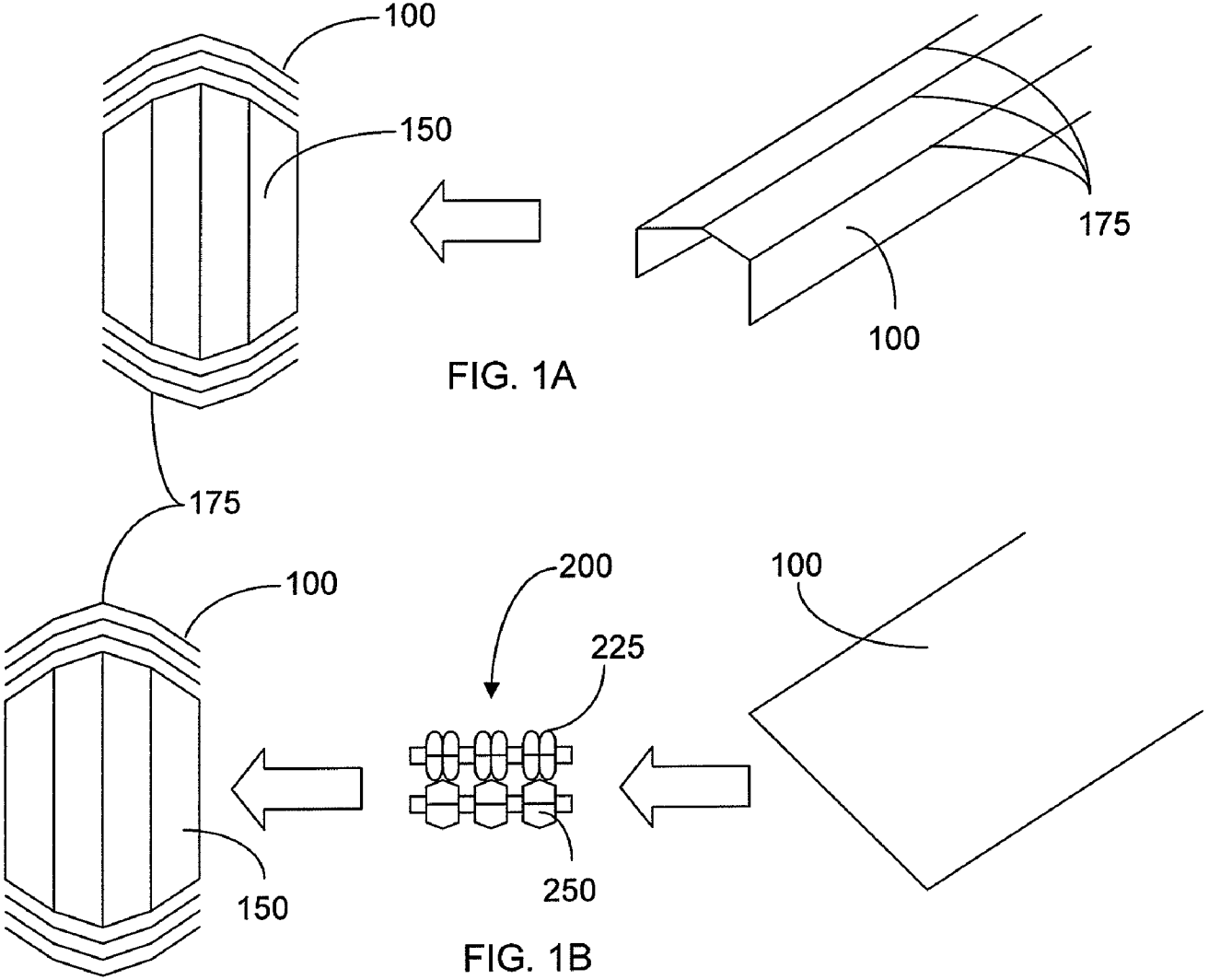
FIGS. 1A and 1B are alternate schematics of an elongate creased material, and wrapping of the same onto a spool member, according to one aspect of the present invention.

As shown in FIG. 1A, the appropriate wrapping material/plug wrap material (i.e., element 100) may be "pre-creased" or otherwise formed to have at least one appropriate crease, prior to the material 100 being prepared as the bulk supply. Such a bulk supply may comprise, for example, the material 100 wound on a bobbin or other suitable spool member 150 (shown in cross-section with the material 100 wound thereon), wherein the bulk material 100, thus configured, may be fed to the respective tobacco rod/filter element manufacturing process in a substantially continuous manner. In some instances, each of the tobacco rod and filter element are subdivided from a longer, continuous rod member formed during the manufacturing process. In such instances, the material 100 may be provided in a continuous strip form from the bobbin 150. As such, as shown in FIG. 1A, the respective material 100 in strip form may have at least one lengthwise-extending crease 175, wherein the transverse width of the strip is suitable for circumscribing the respective smokable filler material or filter material. The number of lengthwise-extending creases 175 may, in some instances, be indicative of the resulting cross-sectional shape of the respective tobacco rod/filter element. For example, three separate creases across the width of the strip, as shown in FIG. 1A, may indicate that the resulting tobacco rod/filter element has a substantially quadrilaterally-shaped cross-section (i.e., a substantially square such as shown, for example, in FIG. 2). Since the opposed widthwise edges of the strip are secured together to form the respective tobacco rod/filter element, one skilled in the art will appreciate that the material is creased in such a manner that the opposed widthwise edges at least partially overlap when wrapped about the smokable filler material/filter material to form the respective tobacco rod/filter element. As further shown in FIG. 1A, the bobbin 150 may also be configured to maintain the lengthwise creases 175 in the material 100. For example, the bobbin 150 may be configured with obliquely-engaged portions across the width thereof, with the engagement between the portions corresponding to the creases 175 in the material 100.

According to another aspect of the present invention, the material 100 may be provided as a flat strip, wherein the flat strip is appropriately creased, for example, by a forming or stressing process, as the material 100 is wound onto the bobbin 150, or unwound from the bobbin 150. For example, the bobbin 150 may be part of an overall bobbin assembly, wherein the bobbin assembly may include a creasing device 200 for lengthwise creasing the material 100. In one instance, the creasing device 200 may comprise, for example, a pair of complementarily-opposed roller devices 225, 250 for each desired crease (with three such creasing devices 200 shown in FIG. 1B corresponding to three lengthwise-extending creases in the material 100). Once the material 100 is creased by the creasing device 200, the material 100 is wound on a bobbin or other suitable spool member 150 (shown in cross-section with the material 100 wound thereon). As further shown in FIG. 1B, the bobbin 150 may also be configured to maintain the lengthwise creases 175 in the material 100. For example, the bobbin 150 may be configured with obliquely-engaged portions across the width thereof, with the engagement between the portions corresponding to the creases 175 in the material 100.

One skilled in the art will appreciate that a "crease" is not necessarily limited to a sharp transition between two planar segments. As used herein, the term "crease" encompasses, when viewed from a cross-sectional perspective, any discontinuity occurring at an intersection of two converging segments. Such an intersection may be "sharp" where two planar or linear segments intersect. However, in other instances, the discontinuity may be at least partially arcuate. That is, the "edge" formed by the crease may be a sharply angled edge, or a rounded edge, where any such edge may be formed, for example, by bending, folding, stressing, or any other suitable forming process. Similarly, the converging segments are not necessarily linear or planar, but may also be at least partially arcuate. Accordingly, one skilled in the art will appreciate that creasing the material 100 may result in different post-forming configurations including, for example, relatively straight, non-curved, substantially linear, or arcuate sides or segments having a bent, folded, or otherwise formed sharp or arcuate discontinuity therebetween. In such instances, one skilled in the art will also appreciate that the formation of a crease results in a substantially concave surface of the material 100 (i.e., "inside" the crease) wherein, according to aspects disclosed herein, the concave surface is configured to receive the smokable filler material (to form the tobacco rod) or the filter material (to form the filter element).

As shown, for example, in FIG. 2, the bulk material 100 configured with the at least one crease 175 and wound on the bobbin 150, may be fed from the bobbin 150 in a substantially continuous manner to the respective tobacco rod/filter element manufacturing process to form the respective tobacco rod/filter element (indicated, for example, by rod member 275 in FIG. 2). As previously discussed, each of the tobacco rod and filter element are subdivided from the longer, continuous rod member 275 formed during the manufacturing process. In such instances, the material 100 may be provided in a continuous strip form from the bobbin 150 and applied about the smokable filler material/filter material, for example, in a garniture region of a cigarette making apparatus, as will be appreciated by one skilled in the art (see, e.g., U.S. Pat. No. 2,308,323 to Williams, which is incorporated herein by reference). That is, the creased material 100 may be unwound from the bobbin 150 and applied about the smokable filler material/filter material such that the opposed widthwise edges of the strip overlap and are secured together to form the respective tobacco rod/filter element. One skilled in the art, however, will appreciate that the material 100 may, in some instances, be supplied in an uncreased manner from the bobbin 150, wherein a suitable creasing device 200 may be implemented to appropriately crease the material, prior to the material 100 is wrapped about the smokable filler material/filter material to form the respective tobacco rod/filter element.

Figure 3:
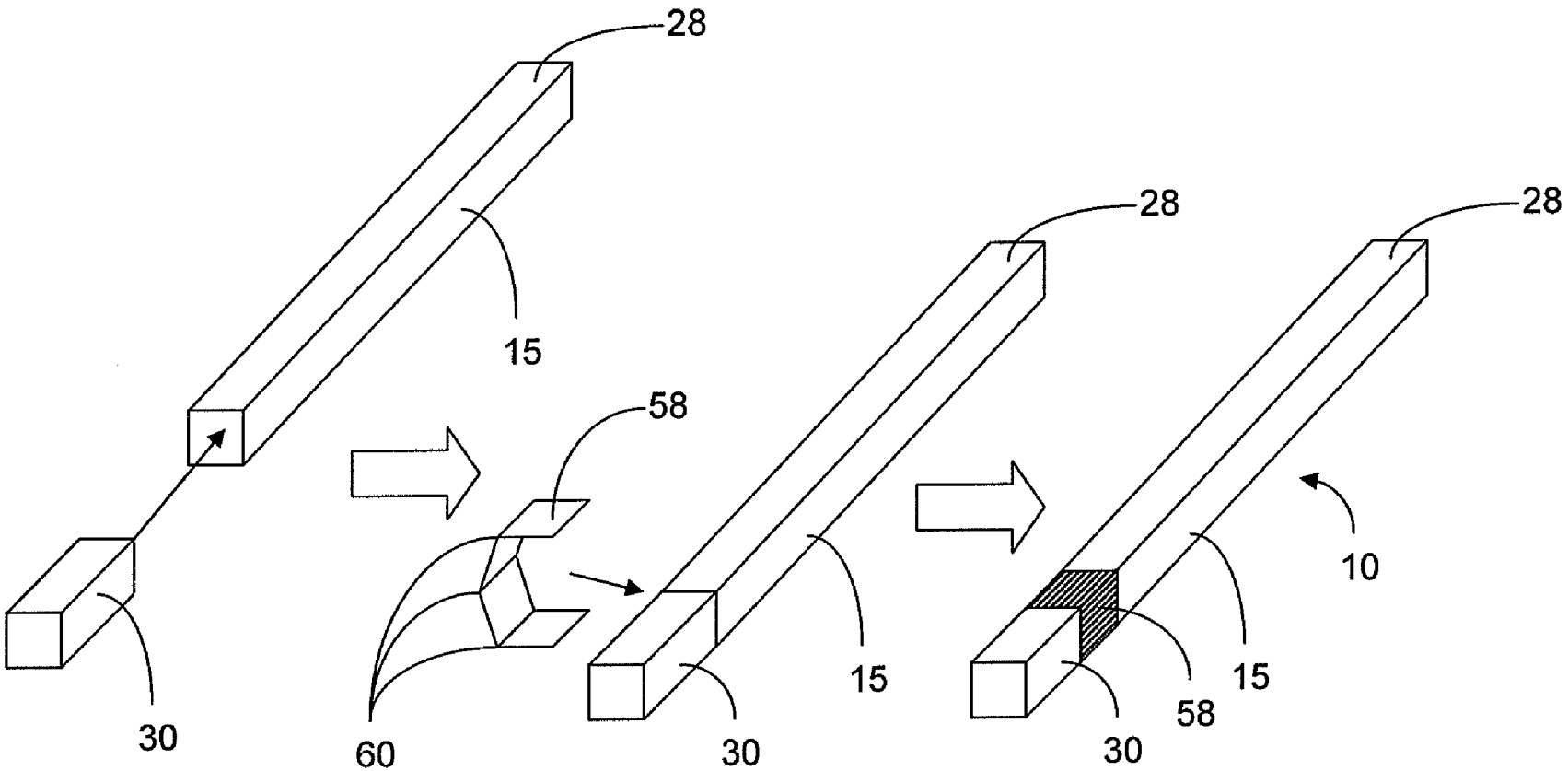
FIG. 3 is a schematic of a cigarette forming process, whereby a filter element is aligned with a tobacco rod element in an abutting relation, wherein the components are then joined by application of a single-portion tipping material thereabout to form a cigarette.

FIG. 3 illustrates one aspect of the present invention, whereby a filter element 30 is attached to a tobacco rod 15 to form a filtered cigarette or other filtered smoking article 10. That is, at one end of the tobacco rod 15 is the lighting end 28, opposing the other end attached to the filter element 30. The filter element 30 and the tobacco rod 15 are axially aligned in an end-to-end relationship, preferably abutting one another, for example, by an aligning device (not shown). The filter element 30 is generally attached to the tobacco rod 15 using a tipping material 58 (e.g., an essentially air-impermeable tipping paper), that circumscribes both the entire length of the filter element 30 and an adjacent region of the tobacco rod 15. The application of the tipping material may be accomplished, for example, using a tipping device, as will be appreciated by one skilled in the art. The inner surface of the tipping material 58 is fixedly secured to the outer surface of the plug wrap material of the filter element 30 and the outer surface of the wrapping material of the tobacco rod 15 using, for example, a suitable adhesive; and hence, the filter element 30 and the tobacco rod 15 are connected to one another.

Figure 4:
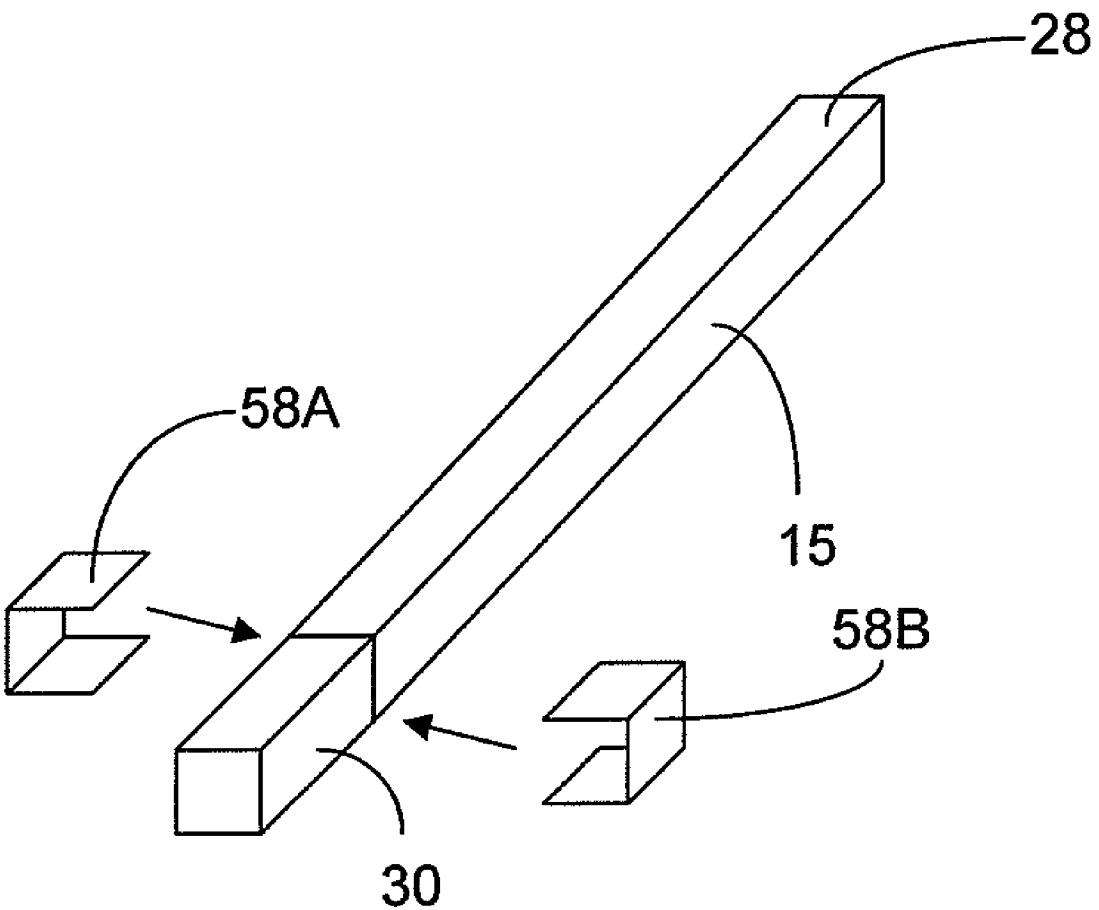
FIG. 4 is a schematic of a cigarette forming process, whereby a filter element is aligned with a tobacco rod element in an abutting relation, wherein the components are then joined by application of a multi-portion tipping material thereabout to form a cigarette.

In furtherance of other aspects of the present invention, one consideration arising from non-circular filter elements 30/tobacco rods 15 is the application of the tipping material 58 about the interface therebetween. As such, one additional aspect involves applying a tipping material 58 having at least one transverse crease 60 corresponding to the at least one crease 175 of the filter element 30 and tobacco rod 15. That is, in some instances, the tipping material 58 may be configured as an elongate strip that is wrapped about the interface between the filter element 30 and tobacco rod 15 so as to continuously circumscribe the rod element and such that the opposed longitudinal ends at least partially overlap (see, e.g., FIG. 3). As with the plug wrap material and/or the wrapping material, the continuous strip of tipping material 58 may be pre-creased prior to being wound into a bulk supply, may be creased as it is being wound into the bulk supply, or may be wound in an uncreased form and then creased immediately prior to being applied about the joint between the filter element 30 and the tobacco rod 15. In other instances, the tipping material may be provided in two or more portions 58A, 58B (see, e.g., FIG. 4), wherein each portion may have a laterally-extending crease, as appropriate. In such instances, the tipping material portions 58A, 58B are configured to cooperate in order to circumscribe the rod element. That is, each tipping material portion 58A, 58B is applied about the interface between the filter element 30 and the tobacco rod 15 such that each end of the respective portion overlaps with an end of another portion, wherein, together, the tipping material portions circumscribe the rod element. Such application of the tipping material may be accomplished, for example, using a conventional tipping device or, in other instances, by way of a rotation device configured to rotate the abutted filter element 30/tobacco rod 15, as the tipping material 58 is applied thereabout.

Figure 5:
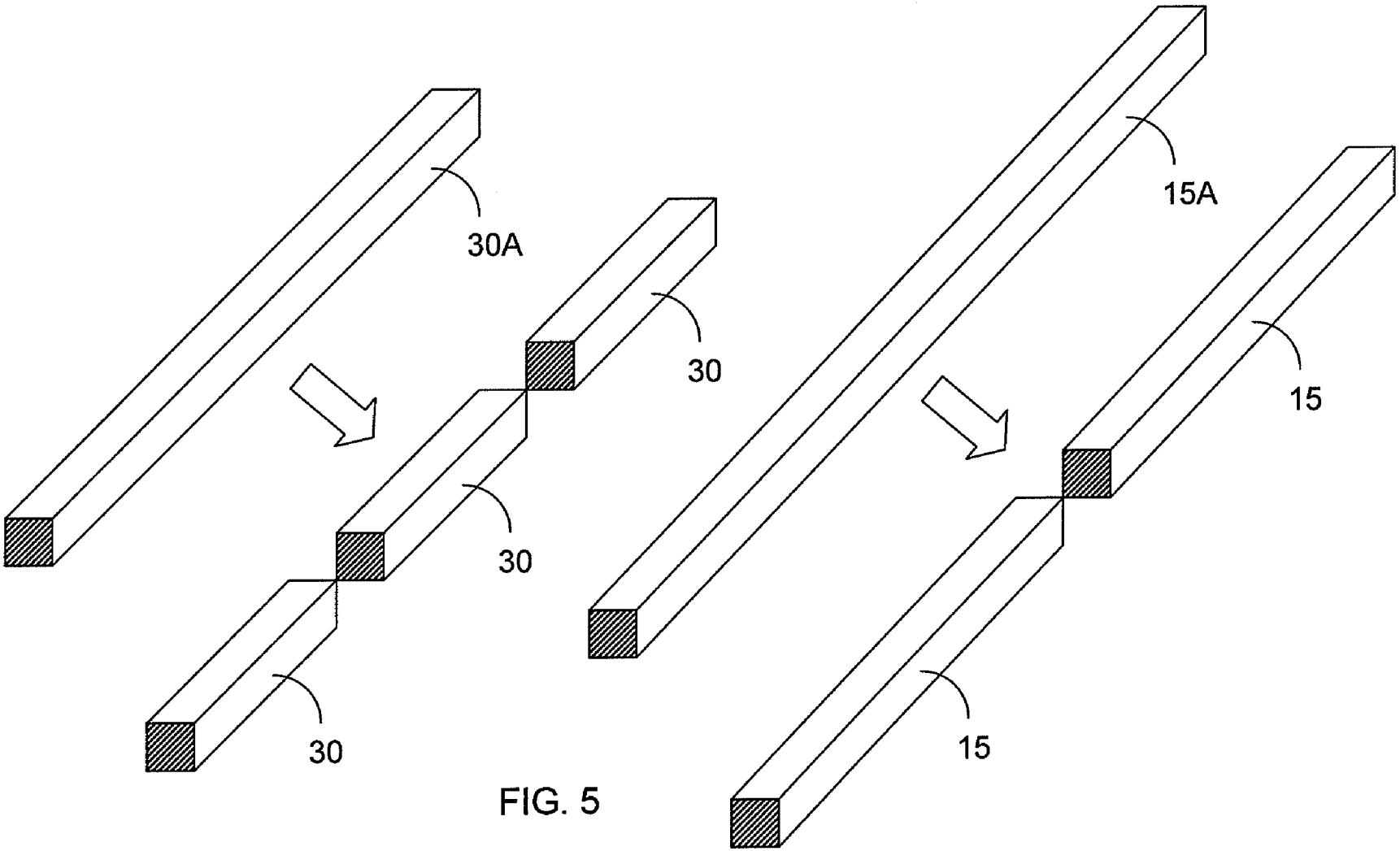
FIG. 5 is a schematic of a cigarette forming process, whereby a plurality of filter elements are formed from an elongate and contiguous filter rod, and a plurality of tobacco rods are formed from an elongate and contiguous tobacco rod, to form respective filter element and tobacco rod supplies.

Another aspect of the present invention is directed to joining the filter element 30 and the tobacco rod 15 together in different manners, in an alternative to the application of a tipping material about an abutting joint therebetween, as previously discussed. For example, as shown in FIG. 5, an elongate and contiguous filter rod 30A may first be formed, as well as an elongate and contiguous tobacco rod 15A, with each having a non-circular cross-sectional shape, wherein such forming processes are disclosed herein. That is, such non-circular cross-sectional shapes may comprise, for example, a trilateral or a quadrilateral, or may otherwise include at least one crease therein. The respective contiguous rods 30A, 15A, may each then be subdivided into sub-elements such as, for example, filter elements 30 and tobacco rods 15. The sub-elements 30, 15 may then be respectively directed to a filter rod supplying device and a tobacco rod supplying device (not shown). The tobacco rods 15 and filter elements 30 may then be fed from the respective supplying devices to an aligning device (not shown) configured to axially align and abut one end of a tobacco rod 15 with one end of a filter element 30.

Such aligning and abutting of the sub-elements may be accomplished in different manners, as will be appreciated by one skilled in the art. For example, the filter elements 30 and tobacco rods 15 may be supplied to the aligning device so as to be placed and aligned in a serially alternating order. That is, each end of a tobacco rod 15 may abut an end of a different filter element 30 and, likewise, each end of a filter element 30 may abut an end of a different tobacco rod 15 as shown, for instance, in FIGS. 6 and 7. Once the sub-elements 30, 15 are aligned and abutted, a garniture material 5 may then be applied thereabout, as will be appreciated by one skilled in the art (see, e.g., FIGS. 6 and 7). The garniture material 5 may, in some instances, be longitudinally creased as appropriate or desired, and various manners of creasing the garniture material 5 and storing the creased garniture material 5 in an appropriate bulk supply may be accomplished as otherwise detailed herein.

Further, the manufacture of multi-segment components can be carried out using combination equipment of the type available under the brand name Mulfi or Merlin from Hauni Maschinenbau AG of Hamburg, Germany; or as LKF-01 Laboratory Multi Filter Maker from Heinrich Burghart GmbH. Combination of various segments or cigarette components also can be carried out using conventional-type or suitably modified devices, such as tipping devices available as Lab MAX, MAX, MAX S or MAX 80 banding devices from Hauni Maschinenbau AG or suitable garniture devices or other wrapping devices. That is, rods, segments and combined segments can be fed (e.g., using trays, hoppers, wheels, and the like), aligned, tipped or otherwise connected, subdivided, turned, conveyed, separated and collected (e.g., using trays, belts, hoppers, and the like) using appropriately modified and arranged tipping devices, garniture devices, and/or other wrapping devices. See, for example, the types of devices and combination techniques set forth in U.S. Pat. No. 3,308,600 to Erdmann et al.; U.S. Pat. No. 4,280,187 to Reuland et al.; U.S. Pat. No. 4,281,670 to Heitmann et al.; and U.S. Pat. No. 6,229,115 to Vos et al.; and US Pat. Publication. No. 2005/0194014 to Read, Jr.

The garniture material 5 may, in some instances, be wrapped about the abutting tobacco rods 15/filter element 30, such that the garniture material 5 extends along an entire combined length of the abutting sub-elements 15, 30. The garniture material 5 thus wrapped and secured about the combination of sub-elements 15, 30 forms a contiguous rod 7 (see, e.g., FIGS. 8 and 9), wherein the contiguous rod 7 includes the non-circular cross-sectional shape along a length thereof (i.e., wherein at least one longitudinal crease extends along the entire combined length thereof) and thereby, in turn forms and defines at least one cigarette 9. The resulting contiguous rod 7 may then be subdivided, as appropriate, to form the individual cigarettes 9, with each cigarette 9 having the desired non-circular cross-sectional shape along the length of that cigarette 9 (see, e.g., FIG. 8). For example, the contiguous rod 7 may be subdivided using a cutting device 8 such as, for instance, a flying knife. In subdividing the contiguous rod 7, the cutting device 8 may be configured to cut through a tobacco rod segment 15, through a filter element segment 30, and/or through a joint between a tobacco rod segment 15 and a filter element segment 30, wherein such cutting operations are schematically indicated in FIGS. 8 and 9.

Though exemplary cigarette forming procedures have been disclosed herein as involving tobacco rods and filter elements having substantially similar cross-sectional shapes and dimensions, one skilled in the art will also appreciate that such procedures may be appropriately adapted to instances where one of the tobacco rod and the filter element is more sculpted, or less sculpted than the other. That is, in some instances, the disclosed cigarette forming procedures may be altered to join together tobacco rods and filter elements having different cross-sectional shapes from each other. Thus, the examples disclosed herein in this regard are not intended to be limiting with respect to the correspondence, or lack of correspondence, between the cross-sectional shapes of the tobacco rods and filter elements used to form cigarettes.

Another aspect of the present invention involves arranging as-formed cigarettes in a lengthwise array and then lengthwise molding the array so as to collectively mold or otherwise shape the cross-sectional area of each cigarette within the array. In this manner, for example, efficiencies may be achieved in collectively shaping a plurality of cigarettes, as opposed to shaping individual cigarettes one at a time. Such collective shaping of an array of cigarettes can occur in different manners. In any instance, the number of cigarettes arranged and formed in a collective shaping process is preferably equal to the number of cigarettes typically placed into a single package. Such a number is generally 20 cigarettes, though the number may vary. In some instances, the 20 cigarettes may be arranged, for example, into a 4×5 array or arrangement, though such arrangement may also vary. Exemplary arrangements are disclosed, for instance, in U.S. Statutory Invention Registration No. H1271 to Shouse, which is incorporated herein by reference.

As shown in FIGS. 10A and 10B, for example, the as-formed cigarettes may be molded using a molding apparatus generally indicated by the numeral 500. The molding apparatus 500 includes a hopper assembly 550 for receiving the as-formed cigarettes 510, with each of the cigarettes being oriented longitudinally with respect to an axis 520. The hopper assembly 550 includes a series of partitions 525 spaced apart in perpendicular relation to the axis 520, the spacing being sufficient to accommodate the diameter of a single cigarette. As such, once the cigarettes 510 are fed into the hopper assembly 550, the partitions separate the cigarettes into columns representing the width of an array of the cigarettes.

Once arranged into the individual columns, the array of cigarettes is inserted into a mold assembly 600 comprising a first mold portion 610 opposing a second mold portion 620, wherein the first and second mold portions 610, 620 cooperate to define a quadrilaterally-shaped channel therebetween (see, e.g., FIG. 1). In one instance, each of the first and second mold portions 610, 620 are substantially "L" shaped, wherein, when opposed, the "L" shapes cooperate to define the quadrilaterally-shaped channel. The first and second and second mold portions 610, 620 are further configured to be capable of moving relative to each other, along at least one of two perpendicularly-intersecting planes (i.e., along a horizontal and/or vertical plane associated with an axis extending through the quadrilaterally-shaped channel). In this manner, the array can be compressed or otherwise molded to obtain the desired quadrilateral shape.

Accordingly, the cigarettes disposed within the hopper assembly 550 must be inserted into the mold assembly 600 such that the molding of the array of cigarettes 510 can occur. The cigarettes in the hopper assembly 550 are thus moved along the axis 520 by a plunger device 700 operably engaged with the hopper assembly 550. In one instance, the plunger device 700 may comprise, for example, a plurality of elongate members 710 corresponding at most to the number of columns defined by the hopper assembly 550, wherein each elongate member 710 is capable of fitting between a pair of the spaced-apart partitions. The elongate members 710 are secured together in spaced-apart relation so as to be capable of simultaneously being moved along the axis 520 and inserted into and through the corresponding columns of the hopper assembly 550, toward an opposing rear wall member 560 of the hopper assembly 550. A handle block 720 is attached to the elongate members 710, and is directed by guide bars 730 to move the elongate members 710 along the axis 520, through a guide bar 740 and into cooperation with the hopper assembly 550.

Generally, the elongate members 710 each have a height corresponding to the "height" or rows of cigarettes in the array. That is, each elongate member 710 defines a height that extends vertically along the respective column so as to contact a number of cigarettes in that column, wherein the number of contact cigarettes contacted in the column is equal to the desired number of rows in the array (i.e., the array may include five columns with four rows of cigarettes). However, due to friction between the cigarettes in a column, the elongate members 710 may not be solely effective in separating a desired number of cigarettes in a particular column from other cigarettes loaded into the hopper assembly 550 and exerting a force on the "lower" cigarettes between the partitions due to the gravity feed mechanism employed by the hopper assembly 550. As such, in some instances, the rear wall member 560 may have a separator device 570 operably engaged therewith. The separator device 570 extends perpendicularly to the partitions and defines a hopper output port (not shown), through which the array of cigarettes 510 is urged by the plunger device 700.

The molding apparatus 500 is further configured such that the mold assembly 600 can be disposed adjacent to the hopper output port such that the quadrilaterally-shaped channel is aligned therewith. That is, in one position, the axis extending through the quadrilaterally-shaped channel is coaxially disposed with the axis 520 extending through the hopper output port. In this manner, the array of cigarettes 510 urged through the hopper output port is lengthwise inserted into the quadrilaterally-shaped channel defined by the mold assembly 600. Further, each of the first and second mold portions 610, 620 includes a length at least as long as the cigarettes. As such, in one instance, the plunger device 700 is configured to urge the array of cigarettes 510 through the hopper output port and into the quadrilaterally-shaped channel defined by the first and second mold portions 610, 620 such that the entire lengths of the cigarettes are disposed therein. One skilled in the art will further appreciate that a cigarette is typically formed with a substantially circular cross-sectional area extending along the length of the cigarette. Accordingly, when arranged in an array, the array will include lengthwise voids between adjacent cigarettes. As such, upon being positioned adjacent to the hopper output port to receive the array of cigarettes 510, the quadrilaterally-shaped channel defined by the mold assembly 600 defines a cross-sectional area at least as great as the collective cross-sectional area defined by the array of cigarettes 510 (i.e., the "envelope" cross-sectional area of the array of circular cigarettes when viewed from a longitudinal end thereof).

Once the array of cigarettes 510 is disposed within the mold assembly 600, one aspect of the present invention contemplates that the first and second mold portions 610, 620 are movable relative to each other, so as to retain the array of cigarettes 510 within the quadrilaterally-shaped channel while also maintaining the quadrilateral configuration of the channel, so as to collectively mold the array of cigarettes 510 into a corresponding quadrilateral configuration through compression of the array. That is, the array of cigarettes 510 may be collectively and appropriately shaped into conformance with the quadrilaterally-shaped channel, by compressing the collective array via the mold assembly 600 so as to mold or otherwise change the cross-sectional shape of at least one of the cigarettes to at least partially reduce the collective cross-sectional area of the array (see, e.g., FIG. 11). Such collective molding of the array through a compression mechanism may, as a result, reduce the volume of the lengthwise voids otherwise present in the array of pre-compression circular cross-section cigarettes 510.

Such relative movement between the first and second mold portions 610, 620 may be accomplished, for example, using a compression system 800. According to one aspect, the first mold portion 610 is supported by a first support portion 810 that is slidably movable transversely (i.e., substantially perpendicularly) to the axis 520. The second mold portion 620 is supported in opposing relation to the first mold portion 610 by a second support portion 820. The second support portion 820 is also slidably engaged with a guide block 830 via a guide member 840. As such, when the array of cigarettes 510 is received within the mold assembly 600, the compression system 800 and the mold assembly 600 supported thereby are disposed adjacent to the hopper output port. The mold assembly 600 having the array of cigarettes 510 therein is then moved laterally with respect to the axis 520 by the compression system 800 toward a completion position 890. Between the position adjacent to the hopper output port and the completion position 890, the second support portion 820 is moved toward the first support portion 810 through cooperation between the guide member 840 and a compression slot 850 defined by the guide block 830. That is, the compression slot 850 may include a downward step, slope, or other transition that directs the guide member 840 (and thus the second support portion 820 engaged therewith) toward the first support portion 810 (i.e., vertically and/or horizontally) as the compression system 800 is moved toward the completion position 890. As such, the compression slot 850/guide member 840/second support member 820 cooperate to function as an actuator for urging the second mold portion 620 toward the first mold portion 610.

One skilled in the art will appreciate, however, that an actuator device may also be operably engaged with the first mold portion 610 so as to urge the first mold portion 610 toward the second mold portion 620. Thus, the configuration disclosed herein is for exemplary purposes only and not intended to be limiting with respect to the possible configurations in this regard. Further, one skilled in the art will also appreciate that any directional references (i.e., horizontal, vertical, laterally, longitudinally, etc.) are used herein for the purposes of description and clarification, wherein, in many instances, the concept being described is one of relation movement between components disclosed herein. As such, aspects of the present invention contemplate that various orientations of one or more of the components discussed herein are within the intended scope of the disclosure.

When the compression system 800 is urged to and reaches the completion position 890, the first and second mold portions 610, 620 have, in turn, been urged by the first and second support portions 810, 820 into cooperation to define the molded cross-sectional area of the array of cigarettes 510. That is, the array is collectively molded into the desired "envelope" cross-sectional shape. In some instances, this may produce a quadrilateral array of individual substantially quadrilaterally-shaped cigarettes with little or no void between adjacent cigarettes. For example, the compressive forces exerted upon the collective array causes the perimetric cigarettes in the array to transfer the compressive forces to the interior cigarettes of the array such that each of the cigarettes in the array is compressed and thus "molded" into substantially the desired cross-sectional shape along the entire length of each cigarette. Collectively molding an array of cigarettes in this manner realizes benefits in efficiency over processes that mold individual cigarettes one-by-one. Further, the compressed/molded array of cigarettes 510 may also require less packaging volume. That is, since the void between adjacent cigarettes in the array is reduced, minimized, or eliminated, less packaging volume is required to contain the collectively molded cigarettes.

In some instances, the compression system 800 may be configured to relax some of the compression forces exerted on the array of cigarettes 510 during the molding process, once the mold assembly 600 is disposed at the completion position 890. That is, for example, the compression slot 890 may include a slight "upward" tendency at or about the completion position so as to relax or relieve the compression forces exerted on the mold assembly 600 via the compression system 800. The relieved or relaxed compressive forces may also permit and facilitate the ejection of the molded array longitudinally outward from the quadrilaterally-shaped channel and directly into a package, such as a cigarette jacket 950 (see, e.g., FIGS. 13A and 13B). The cigarette jacket 950 may be configured to have a cross-sectional shape and area sufficient and appropriate for receiving the molded array of cigarettes 510 from the mold assembly 600 via, for instance, an ejector port defined by the compression system 800. In such instances, the cigarette jacket 950 and ejector port may be configured for mutual cooperation therebetween so as to allow the molded array 510 to be received by and completely within the cigarette jacket 950. According to one aspect, the molded array of cigarettes 510 can be urged from the mold assembly 600, through the ejector port, and into the cigarette jacket 950 using, for example, an ejector device 900 comprising an ejector bar 910 movable along an axis 920 extending through the mold assembly 600 at the completion position 890, wherein the ejector bar 910 may be movable through and guided by a guide port (not shown) defined by the guide block 830. Once the array is urged into the cigarette jacket 950, sufficient force may be maintained on the array 510 so as to maintain the collective molded shape thereof. The filled cigarette jacket 950 can then be inserted into a cigarette pack 960 which may, in some instances, be the complete or final packaging of the molded array of cigarettes 510. In order to access the molded cigarettes, the smoker would open the cigarette pack 960 and extract a cigarette from the cigarette jacket 950 therein.

According to another aspect of the present invention, an array of cigarettes 510 may be collectively molded in different manners. For example, in place of the mold assembly 600/compression system 800, the molding apparatus 500 may comprise a molding element 1000 (see, e.g., FIG. 12) defining an elongate channel having an input end 1010 and an opposed output end 1020 aligned along an axis 1030. The input end 1010 is configured to receive the array of cigarettes 510 from the hopper assembly 550, through the hopper output port, when the molding element 1000 is aligned therewith such that the axis 1030 thereof is coaxially disposed with the axis 520. In such instances, the input end 1010 is configured to be capable of receiving the "envelope" cross-sectional area of the unmolded array of circular cigarettes 510, and defines an input cross-sectional area. Further, the output end 1020 is configured to have an output cross-sectional shape corresponding to the desired "envelope" cross-sectional shape of the molded array of cigarettes 510 when viewed from a longitudinal end thereof. Accordingly, the output cross-sectional area of the output end 1020 is less than the input cross-section area of the input end 1010. However, the output cross-sectional area is, in most instances, no less than the envelope cross-sectional area of a molded array 510 having no voids between the cigarettes (i.e., no less than the sum of the cross-sectional areas of each of the cigarettes in the array.

In this manner, the plunger device 700 is configured as an advancement device to advance the array of cigarettes 510 through the hopper output port and into the input end 1010 of the molding element 1000. The plunger device 700, or other suitable advancement device, is further configured to advance the array of cigarettes 510 through the elongate channel and along the axis 1030. As such, as the array of cigarettes 510 is advanced from the input end 1010 and through the output end 1020, the array of cigarettes 510 is molded along the length thereof at least by the output end 1020. One skilled in the art will appreciate that molding the array may be accomplished, in some instances, at least partially by the configuration of the elongate channel between the input and output ends 1010, 1020. The molding element 1000 is thus configured such that the array exits the output end 1020 at least partially in correspondence with the output cross-sectional shape. One skilled in the art will further appreciate that, in order to avoid damage to the cigarettes during the molding procedure, at least one surface of the molding element 100 defining the elongate channel may be comprised of a lubricious material.

Once advanced through the output end 1020, the molded array 510 may be directed directly into a package, such as a cigarette jacket 950, operably engaged with the output end 1020. As previously discussed, the cigarette jacket 950 may be configured to have a cross-sectional shape and area sufficient and appropriate for receiving the molded array of cigarettes 510 from the mold element 1000 via the output end 1020. Once the array is urged into the cigarette jacket by the plunger device 700, sufficient force may be maintained on the array so as to maintain the collective molded shape thereof. The filled cigarette jacket 950 can then be inserted into a cigarette pack 960 which may, in some instances, be the complete or final packaging of the molded array of cigarettes 510. In order to access the molded cigarettes, the smoker would open the cigarette pack 960 and extract a cigarette from the cigarette jacket 950 therein.

Many modifications and other embodiments of the inventions set forth herein will come to mind to one skilled in the art to which these inventions pertain having the benefit of the teachings presented in the foregoing descriptions and the associated drawings. For example, at least one apparatus embodiment may be implemented and claimed. More particularly, one apparatus aspect may comprise a cigarette-making apparatus adapted to form a cigarette, wherein such an apparatus may include a tobacco rod-forming device configured to form an elongate tobacco rod having a non-circular cross-sectional shape and opposed ends, the tobacco rod including a wrapping material circumscribing a tobacco charge; a filter rod-forming device configured to form a filter element having opposed ends and a non-circular cross-sectional shape corresponding to the cross-sectional shape of the tobacco rod, the filter element including a plug wrap material circumscribing a filter material; an aligning device configured to axially align and abut one end of the tobacco rod with one end of the filter element; and a tipping device configured to apply a tipping material about the tobacco rod and the filter element, the tipping material extending across the abutting ends thereof, so as to join the tobacco rod with the filter element and form a cigarette having a non-circular cross-sectional shape along a length thereof.

Such an apparatus may further provide that the tobacco rod-forming device is configured to form the elongate tobacco rod, and the filter rod-forming device is configured to form the filter element, such that the non-circular cross-sectional shape of each of the tobacco rod and the filter element comprises at least one of a trilateral and a quadrilateral.

Such an apparatus may also provide that the tobacco rod-forming device is configured to form the elongate tobacco rod such that at least one longitudinal crease in the wrapping material extends along a length of the tobacco rod, and the filter rod-forming device is configured to form the filter element, such that at least one longitudinal crease in the plug wrap material extends along a length of the filter element. Another aspect of such an apparatus is that at least one of the wrapping material and the plug wrap material is creased prior to being wound on a bobbin, wherein at least one of the tobacco rod-forming device and the filter rod-forming device is further configured such that the creased material is fed thereto from the bobbin for correspondingly forming at least one of the tobacco rod and the filter element. In an alternate aspect of such an apparatus, at least one of the tobacco rod-forming device and the filter rod-forming device includes a bobbin assembly having a bobbin configured to correspondingly receive at least one of the wrapping material and the plug wrap material wound thereon, wherein the bobbin assembly is further configured to form the crease in the material wound on the bobbin. Still another alternate aspect of such an apparatus provides that the tipping material includes at least one laterally-extending crease, whereby the at least one crease of the tipping material extends across the abutting ends of the tobacco rod and filter element such that the at least one crease of the tipping material corresponds to the at least one crease of each of the tobacco rod and filter element being joined. In those instances, the tipping material may be a single continuous strip configured to extend entirely about the joint between the tobacco rod and filter element such that opposing ends of the strip at least partially overlap. Alternately, the tipping material may comprise a plurality of strips configured to cooperate so as to extend entirely about the joint between the tobacco rod and filter element, whereby each end of each strip at least partially overlaps with an end of another strip.

Such an apparatus may also provide that the tipping device further comprises a rotation device configured to at least partially rotate the axially abutted tobacco rod and filter element about an axis defined thereby, and a wrapping device configured to apply the tipping material about the axially abutted tobacco rod and filter element upon the rotation thereof by the rotation device.

Yet another apparatus aspect may comprise a cigarette molding apparatus adapted to mold at least one cigarette, wherein each cigarette has a length and a cigarette cross-sectional shape defining a cigarette cross-sectional area, and such an apparatus includes a molding element defining an elongate channel having an input end and an opposed output end aligned along an axis, the input end being configured to receive the at least one cigarette having the length thereof coaxially disposed with the axis, and the output end having an output cross-sectional shape defining an output cross-sectional area no less than the cigarette cross-sectional area; and an advancement device operably engaged with the molding element and configured to advance the at least one cigarette through the elongate channel and along the axis, from the input end and through the output end, such that the at least one cigarette is molded along the length thereof by the output end, at least partially in correspondence with the output cross-sectional shape, upon advancement therethrough.

Such an apparatus may further comprise a packaging device operably engaged with the output end of the molding element, the packaging device being configured to manipulate a cigarette jacket with respect to the output end so as to receive the at least one molded cigarette therein as the at least one cigarette is advanced therethrough by the advancement device. The packaging device may be further configured to insert the cigarette jacket having the at least one molded cigarette therein into a cigarette pack.

Such an apparatus may provide that the input end defines an input cross-sectional area greater than the output cross-sectional area, and/or that the output cross-sectional shape is a quadrilateral. The input end may be configured to receive a plurality of cigarettes arranged in an array, with each of the plurality of cigarettes having a substantially circular cross-sectional shape. In such instances, the output cross-sectional shape may be a quadrilateral, and the output end may be further configured such that the array of cigarettes is collectively molded into the quadrilateral output cross-sectional shape. In further instances, the quadrilateral may further comprises a square, wherein each of the cigarettes in the array is molded into a substantially square cross-sectional shape when the array of cigarettes is advanced through the output end by the advancement device.

Such an apparatus may further provide that the molding element includes at least one surface defining the elongate channel, wherein the at least one surface comprises a lubricious material.

Another apparatus aspect may comprise a cigarette molding apparatus adapted to mold a plurality of cigarettes, wherein each cigarette has a length and a cigarette cross-sectional shape, and such an apparatus includes a first mold portion configured to receive a length-wise array of cigarettes, the first mold portion longitudinally extending for at least the length of the cigarettes; a second mold portion extending for at least the length of the cigarettes and configured to complementarily engage the first mold portion so as to define a molded cross-sectional shape and to retain the array of cigarettes therebetween; and an actuator operably engaged with at least one of the first and second mold portions, the actuator being configured to urge one of the first and second mold portions toward the other of the first and second mold portions so as to collectively mold the array of cigarettes according to the molded cross-sectional shape.

Such an apparatus may further comprise an ejector device configured to eject the molded array of cigarettes from the first and second mold portions after the array of cigarettes is molded into the molded cross-sectional shape. In such instances, the apparatus may further comprise a packaging device configured to manipulate a cigarette jacket with respect to the first and second mold portions so as to receive the molded array of cigarette therein after ejection thereof by the ejector device. The packaging device may be further configured to insert the cigarette jacket having the at molded array of cigarette therein into a cigarette pack.

Yet another apparatus aspect may comprise a cigarette-making apparatus adapted to form a cigarette, wherein such an apparatus includes a tobacco rod supplying device configured to supply at least one tobacco rod having a non-circular cross-sectional shape and opposed ends, each tobacco rod including a wrapping material circumscribing a tobacco charge; a filter rod supplying device configured to supply at least one filter element having opposed ends and a non-circular cross-sectional shape corresponding to the cross-sectional shape of the at least one tobacco rod, each filter element including a plug wrap material circumscribing a filter material; an aligning device configured to receive the at least one tobacco rod from the tobacco rod supplying device and the at least one filter element from the filter rod supplying device, the aligning device being further configured to axially align and abut one end of the at least one tobacco rod and one end of the at least one filter element; and a wrapping device configured to apply a garniture material about the at least one tobacco rod and the abutting at least one filter element, and along an entire combined length thereof, so as to join the at least one tobacco rod with the at least one filter element and form a contiguous rod including at least one cigarette, each of the at least one cigarette having a non-circular cross-sectional shape along a length thereof.

Such an apparatus may further provide that the tobacco rod supplying device is configured to supply the at least one tobacco rod, and the filter rod supplying device is configured to supply the at least one filter element, with the non-circular cross-section of each of the at least one tobacco rod and the at least one filter element comprising one of a trilateral and a quadrilateral.

Such an apparatus may also provide that the wrapping device is configured to apply the garniture material about the at least one tobacco rod and the abutting at least one filter element such that at least one longitudinal crease extends along the entire combined length thereof. The garniture material may be creased prior to being wound on a bobbin, wherein the wrapping device is further configured such that the creased garniture material is fed thereto from the bobbin for application about the at least one of the tobacco rod and the abutting at least one filter element. Alternately, the wrapping device includes a bobbin assembly having a bobbin configured to correspondingly receive the garniture material wound thereon, wherein the bobbin assembly is further configured to form the crease in the garniture material wound on the bobbin.

Such an apparatus may also provide that the aligning device is further configured to axially align and abut the at least one tobacco rod and the at least one filter element in a serially alternating order.

Such an apparatus may further comprise a cutting device configured to cut the contiguous rod at least one of through one of the at least one tobacco rod, through one of the at least one filter element, and through a joint between one of the at least one tobacco rod and one of the at least one filter element, so as to form a plurality of cigarettes.

Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of molding a plurality of cigarettes, each cigarette having a length and a cigarette cross-sectional shape defining a cigarette cross-sectional area, the method comprising:

inserting a plurality of cigarettes arranged in an array, with each of the plurality of cigarettes having a substantially circular cross-sectional shape, into an input end of an elongate channel of a molding element, the input end of the elongate channel defining an input cross-sectional area, the input end having an opposed output end aligned along an axis, such that the length of each cigarette is coaxially disposed with the axis, the output end having an output cross-sectional shape defining an output cross-sectional area less than the input cross-sectional area, the output cross-sectional shape of the elongate channel being a rectangle; and advancing the cigarettes through the elongate channel and along the axis, from the input end and through the output end, with an advancement device operably engaged with the molding element, such that the cigarettes are molded along the length thereof by the output end, in correspondence with the output cross-sectional shape, upon advancement therethrough such that each cigarette has a non-circular cross-sectional shape upon exiting the output end.

2. A method according to claim 1 further comprising manipulating a cigarette jacket with a packaging device operably engaged with the output end of the molding element, and with respect to the output end, so as to receive the molded cigarettes therein as the cigarettes are advanced through the output end by the advancement device.

3. A method according to claim 2 further comprising inserting the cigarette jacket having molded cigarettes therein into a cigarette pack.

4. A method according to claim 1 wherein inserting the cigarettes further comprises inserting the cigarettes into an input end of an elongate channel of a molding element, and wherein the input end of the elongate channel defines an input cross-sectional area greater than the output cross-sectional area.

5. A method according to claim 1 wherein inserting the cigarettes further comprises inserting the cigarettes into an input end of an elongate channel of a molding element, and wherein the output cross-sectional shape of the elongate channel is a quadrilateral.

6. A method according to claim 1 wherein inserting the cigarettes further comprises inserting the cigarettes arranged in an array, with each of the plurality of cigarettes having a substantially circular cross-sectional shape, into an input end of an elongate channel of a molding element.

* * * * *